US006501436B1

(12) United States Patent
Saito et al.

(10) Patent No.: US 6,501,436 B1
(45) Date of Patent: Dec. 31, 2002

(54) ANTENNA APPARATUS AND WIRELESS APPARATUS AND RADIO RELAYING APPARATUS USING THE SAME

(75) Inventors: Yutaka Saito, Ishikawa (JP); Hiroshi Haruki, Kanagawa (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 09/622,821

(22) PCT Filed: Dec. 17, 1999

(86) PCT No.: PCT/JP99/07120

§ 371 (c)(1),
(2), (4) Date: Aug. 23, 2000

(87) PCT Pub. No.: WO00/39886

PCT Pub. Date: Jul. 6, 2000

(30) Foreign Application Priority Data

Dec. 25, 1998 (JP) ..... 10-370990

(51) Int. Cl.[7] ..... H01Q 11/12
(52) U.S. Cl. ..... 343/867; 343/742; 343/795
(58) Field of Search ..... 343/741, 742, 343/792.5, 793, 795, 797, 866, 867; H01Q 11/12

(56) References Cited

U.S. PATENT DOCUMENTS

| | | | | | |
|---|---|---|---|---|---|
| 3,656,166 | A | * | 4/1972 | Klopach et al. | 343/756 |
| 4,191,959 | A | * | 3/1980 | Kerr | 343/700 MS |
| 5,541,614 | A | * | 7/1996 | Lam et al. | 343/792.5 |
| 5,790,082 | A | * | 8/1998 | Podger | 343/792.5 |
| 6,181,281 | B1 | * | 1/2002 | Desclos et al. | 343/700 MS |
| 6,255,998 | B1 | * | 7/2002 | Podger | 343/867 |

FOREIGN PATENT DOCUMENTS

| | | |
|---|---|---|
| JP | 55-26935 | 2/1980 |
| JP | 60-210012 | 10/1985 |
| JP | 4-44713 | 2/1992 |
| JP | 4-156730 | 5/1992 |
| JP | 5-259733 | 10/1993 |
| JP | 6-44219 | 2/1994 |
| JP | 6-169216 | 6/1994 |
| JP | 6-188623 | 7/1994 |
| JP | 6-268432 | 9/1994 |
| JP | 6-334434 | 12/1994 |
| JP | 7-79192 | 3/1995 |
| JP | 8-125433 | 5/1996 |
| JP | 8-139521 | 5/1996 |
| JP | 8-204433 | 8/1996 |
| JP | 8-298485 | 11/1996 |
| JP | 9-83237 | 3/1997 |
| JP | 9-232851 | 9/1997 |
| JP | 9-289676 | 11/1997 |

OTHER PUBLICATIONS

Yoji Tsunoi et al., "Dynamic Ham Series: Antenna Handbook" (in Japanese), CQ Shuppan K.K., Feb. 28, 1985, p. 366.

* cited by examiner

*Primary Examiner*—Tho Phan
(74) *Attorney, Agent, or Firm*—Pearne & Gordon LLP

(57) ABSTRACT

Antenna elements (1) to (4) are arranged at both ends in a diamond shape, and are located opposite to each other, while a length (a) of one edge of this diamond shape is set to a ½ wavelength (λ/2). Antenna elements (5) to (12) are arranged in such a way that three portions are bent and the bent antenna elements are located opposite to each other, while a length (b) of one edge thereof is set to a ¼ wavelength (λ/4). One ends of the antenna elements (5) to (8) are connected to the antenna elements (1) to (4), whereas the other ends thereof are connected to the antenna elements (9) to (12). The antenna elements (9) and (10), and the antenna elements (11) and (12) are connected to each other at a power supply unit (13). With employment of such a structure, an antenna having a higher gain can be realized with having a simple plane structure.

7 Claims, 10 Drawing Sheets

ANTENNA APPARATUS AND WIRELESS APPARATUS AND RADIO RELAYING APPARATUS USING THE SAME

TECHNICAL FIELD

The present invention is related to an antenna apparatus, and a radio apparatus and a radio relaying apparatus using this antenna apparatus in a mobile communication system mainly known as the PHS (Personal Handyphone System) system.

TECHNICAL BACKGROUND

Conventionally, in an outdoor type small-sized base station apparatus (master unit) conducted in a mobile communication system such as the PHS system, while an omunidirectional antenna such as a sleeve antenna is used, the antenna gain of this omunidirectional antenna is lower than or equal to about 2 dBi. Also, in a fixed terminal apparatus used in a local wireless network (wireless local loop: WLL) which utilizes a mobile communication system such as the PHS system, an antenna gain requires approximately 10 dBi.

Very recently, in the above-described mobile communication system, high gains are required for antennas so as to extend communication covering areas. These antennas are used in indoor type compact base station apparatuses (mother units) and fixed terminal apparatuses.

As frequencies of the above-explained mobile communication system, 1,900 MHz band and 800 MHz band are mainly used. As antennas having high gains operable in these frequency bands, multi-staged co-linear array antennas are known from, for instance, Japanese Patent Publications Hei-5-267932, Hei-9-232851, and Hei-8-139521. This sort of antenna is to secure such a high gain by that while antennas having omnidirectional directivity characteristics within horizontal planes are arranged in the multi-stage manner along the vertical direction, the directivity characteristics within the vertical planes are narrowed by vertical polarized waves.

Also, for instance, as disclosed in Japanese Patent Publications Hei-5-259733 and Hei-8-204433, end-fire array antennas are known, namely typically known as a YAGI antenna and a dipole antenna equipped with a reflection plate. This sort of antenna is to secure a high gain by that non-powered elements are arranged along a direction parallel to a major radiation direction.

Furthermore, for example, as disclosed in Japanese Patent Publication Hei-6-334434, a broad-side array antenna is known, namely typically known as a patch array antenna. This sort of antenna is to secure a high gain by that while a plurality of antennas are arranged within a plane located perpendicular to a major radiation direction, these plural antennas are energized by the distribution manner.

Also, for instance, as described in Japanese Patent Publication Hei-6-268432 and also Japanese Utility Model Publication Hei-6-44219, a slim type antenna is known, namely typically known as a loop antenna equipped with a reflection plate and a slot antenna.

Then, as a broad-side array antenna mainly utilized in the VHF frequency range, for instance, "ANTENNA HANDBOOK" issued by "CQ Publishing Co.", on page 366, discloses such an antenna that two 1-wavelength antennas are arranged in either a regular square or a circle. Then, it is known in the field that a diamond-shaped antenna to which this broad-side array antenna has been applied can obtain a gain of approximately 6 dBi in the 1,900 MHz band and the 800 MHz band, and further, this diamond-shaped antenna having a compact/simple structure can obtain a gain of approximately 10 dBi in combination with a reflection plate.

Also, such an antenna is known in the field, in which plural sets of the above-described diamond-shaped antennas are arranged in a parallel connection manner or a series connection manner. FIG. 3 is a diagram for representing the conventional antenna apparatus structure and the current distribution thereof, in which 6 sets of diamond-shaped antennas are connected to each other in the parallel manner. This antenna apparatus is so arranged that 6 pieces of the diamond-shaped antennas 14 to 19 are connected in the parallel manner, and the power supply unit 20 is connected to the center portion. While the length "a" of one edge of the diamond shape is set to a ½ wavelength ($\lambda/2$), these diamond-shaped antennas 14 to 19 are operated as the broad-side array antenna constituted by 4 sets of half wavelength antennas so as to radiate the vertical polarized waves along the X direction and the −X direction. For instance, in the case that the operation frequency of the antenna apparatus is set to 1,900 MHz, the length "a" of one edge of the diamond shape becomes 79 mm. Also, the entire width of the antenna apparatus becomes 670 mm. In this case, in the antenna apparatus shown in FIG. 3, in particular, the current distribution of the diamond-shaped antennas 16 to 19 located near the center cannot be optimized by mutually coupling the respective diamond-shaped antennas. As a result, it is known in this field that the effect of the plural arrangement becomes relatively small, a single set of the diamond-shaped antenna owns the gain of approximately 11.5 dBi, and the gain of approximately 15.5 dBi is obtained by combining the diamond-shaped antenna with the reflection plate.

Also, for example, Japanese Patent Publications Hei-6-188623 and Hei-6-169216, and Japanese Utility Model Publication Hei-4-44713 describe such a dual-loop antenna that a plurality of 1-wavelength loop antennas are connected parallel to each other, or series to each other. FIG. 4 represents the conventionally known structure of dual-loop antenna. This dual-loop antenna is arranged in such a manner that two sets of the 1-wavelength loop antennas are connected parallel to each other via the ½-wavelength transfer path, and the power supply unit is connected to the central portion. Both the 1-wavelength loop antenna 21 and the 1-wavelength loop antenna 22 are operated in such a way that the vertical polarized waves are radiated along the X direction and the −X direction. While the length of the transfer path 23 is set to a ¼ wavelength and the length of the transfer path 24 is set to a ¼ wavelength,both the 1-wavelength loop antenna 21 and the 1-wavelength loop antenna 22 are connected to each other, and the power supply unit 25 is connected to the center point thereof. Since the dual-loop antenna is arranged in this manner, two sets of the 1-wavelength loop antennas 21 and 22 can be excited under in-phase condition. It is known in the field that a single set of the 1-wavelength loop antenna owns the gain of approximately 8 dBi, and the two 1-wavelength loop antennas own the gain of approximately 12 dBi by being combined with the reflection plate.

On the other hand, as a radio relaying apparatus used in the above-explained mobile communication system, the following radio relaying apparatuses are known in the field. That is, for instance, Japanese Patent Publication Hei-8-8807 discloses such a radio relaying apparatus which employs the antenna commonly-using filter and a large number of narrow-band amplifiers. Japanese Patent Publication Hei-8-508377 discloses such a radio relaying apparatus which uses the amplifier and the switch operable in synchronism with the upstream time instant and the downstream time instant in the time division duplexing (TDD) system. Also, Japanese Patent Publication Hei-8-298485 describes such a radio relaying apparatus in which the two relaying systems constructed of the upstream/downstream relaying systems are provided in the time division duplexing system.

However, in order to secure the high gain in the above-explained conventional multi-stage co-linear array antenna, a large number of antennas must be arrayed in the multi-stage manner along the vertical direction. For example, in the case that the gain of 10 dB is obtained in the 1,900 MHz band, the antenna height of 1 meter would be required. As a result, there are problems in the antenna setting places and also the mechanical strengths of the antennas. Also, it is not proper manner to build such a high-height antenna in the radio apparatus.

Also, in order to secure the high gain in the above-described conventional end-fire array antenna, a large number of antennas must be arrayed in the multi-stage manner along the major radiation direction. As a result, there are such problems in the antenna setting places and also the mechanical strengths of the antennas. Also, since the end-fire array antenna owns such a specific antenna structure, this end-fire array antenna is difficult to be built in the radio apparatus in a proper manner.

Furthermore, in order to secure the high gain in the above-described conventional broad-side array antenna, a large number of antennas must be arrayed on the vertical plane with respect to the major radiation direction. As a result, there are such problems in the antenna setting places and also the mechanical strengths of the antennas, since the entire area of this broad-side array antenna is increased. Also, since the broad-side array antenna owns such a large antenna area, this broad-side array antenna is difficult to be built in the radio apparatus in a proper manner.

Also, the above-described conventional slim type antenna owns such a problem that the radiation directivity characteristic cannot be optimized as the desirable characteristic, although this antenna owns the slim structure.

Then, the tip open diamond-shaped antenna owns another problem that the gain higher than 10 dBi cannot be obtained, which utilizes such an antenna that the two 1-wavelength antennas are arrayed in either the square shape or the circular shape.

Also, in the antenna where a plurality of tip open diamond-shaped antennas shown in FIG. 3 are arrayed in either the parallel connection manner or the series connection manner, in particular, the current distribution of the antenna elements located near the center cannot be optimized, because of the mutual couplings among the adjoining 1-wavelength elements. As a consequence, there is such a problem that the gain improving effect caused by the plural antenna arrangement is lowered.

On the other hand, in the above-explained conventional radio relaying apparatus, the structure of the amplifier capable of obtaining the large relaying gain becomes complex and bulky. Therefore, there is such a problem that such a bulky amplifier cannot be properly installed in an indoor type compact relaying apparatus.

The present invention has been made to solve the above-described various problems belonging to the conventional antennas, and therefore, has an object to realize a high-gain antenna apparatus having a compact, slim, and simple antenna structure usable in mobile communication systems operable in both UHF-frequency range and semi-microwave frequency range. Also, the present invention has an object to realize an indoor type radio relaying apparatus having a compact/simple arrangement.

DISCLOSURE OF THE INVENTION

To solve the above-explained problems, an antenna apparatus, according to the present invention, is featured by that a first antenna and a second antenna are arranged on both end portions in such a manner that each of two 1-wavelength antenna elements is bent at a center portion thereof and the two bent 1-wavelength antenna elements are located opposite to each other so as to thereby form a diamond shape; one end of the first and second antennas is opened; and a connection unit is provided on the other end thereof; a third antenna in which a central half-wavelength portion of each of two 1-wavelength antenna elements is bent in a symmetrical manner with respect to a straight line intersected perpendicular to the antenna elements is arranged at a center portion, both ends of which are connected to the first and second antennas; and a commonly-used power supply unit is provided. Since such a structure is employed, the antenna apparatus having the high gain can be realized with the simple plane structure.

Also, an antenna apparatus, according to the present invention, is featured by comprising: a plurality of antennas formed in a diamond shape in such a manner that each of two 1-wavelength antenna elements is bent at a center thereof and the bent 1-wavelength antenna elements are located opposite to each other; a transfer path; and a reflection plate; wherein:

the plurality of antennas are arranged in such a manner that the plural antennas are separated from each other by keeping an interval defined by multiplying a half wavelength by an integer along a vertical direction with respect to the plane of the diamond shape, and major polarized wave directions thereof are made identical to each other; the plurality of antennas are connected to each other by the transfer path; a tip portion of an antenna system for connecting the plurality of antennas is opened and a power supply unit is provided at the other end thereof; and the reflection plate is arranged to be separated by a predetermined interval along the vertical direction with respect to the diamond-shaped plane of the plural antennas. Since such a structure is employed, the antenna apparatus having the high gain can be realized with the simple structure.

Also, a radio apparatus, according to the present invention, is featured by comprising: a printed board in which an antenna is constructed of a printed pattern; and a wireless circuit unit; wherein: both the printed board and the wireless circuit unit are fixed in a predetermined interval; and a housing of the wireless circuit unit is commonly used as a reflection member. Since such an arrangement is employed, the radio apparatus equipped with the antenna apparatus having the high gain can be realized with the simple arrangement.

Also, a radio relaying apparatus, according to the present invention, is featured by that a plurality of antenna apparatuses are arranged within the same housing in such a manner that major radiation directions of the plural antenna apparatuses are directed to different directions; and power supply units of the plural antenna apparatuses are electrically connected to each other. Since such an arrangement is employed, the radio relaying apparatus installed in the indoor place can be realized with the simple arrangement.

Further, a radio relaying apparatus, according to the present invention, is featured by that a plurality of antenna apparatus are arranged within different indoor spaces from each other; and the respective power supply units of the plural antenna apparatuses are connected to each other via a cable. Since such an arrangement is employed, the radio relaying apparatus installed in the indoor place can be realized with the simple arrangement.

Also, a radio relaying apparatus, according to the present invention, is featured by that a plurality of antenna apparatus are embedded within walls of different rooms from each other; and the respective power supply units of the plural antenna apparatuses are connected to each other via a cable. Since such an arrangement is employed, the radio relaying apparatus installed in the indoor place can be realized with the simple arrangement.

The invention as recited in claim 1 of the present invention is related to such an antenna apparatus wherein: a first antenna and a second antenna are arranged on both end portions in such a manner that each of two 1-wavelength antenna elements is bent at a center portion thereof and the two bent 1-wavelength antenna elements are located opposite to each other so as to thereby form a diamond shape; one end of the first and second antennas is opened; and a connection unit is provided on the other end thereof; a third antenna in which a central half-wavelength portion of each of two 1-wavelength antenna elements is bent in a symmetrical manner with respect to a straight line intersected perpendicular to the antenna elements is arranged at a center portion, both ends of which are connected to the first and second antennas; and a commonly-used power supply unit is provided. The antenna apparatus may own such an effect that the strong radiation can be obtained along the direction perpendicular to the plane of the diamond shape, and also the current distribution of the third antenna can be improved.

The invention as recited in claim 2 of the present invention is related to such an antenna apparatus as claimed in claim 1 wherein: the first to third antennas are constituted by printed patterns formed on a printed board, and both the printed board and a reflection plate are fixed in a predetermined interval. The antenna apparatus may own such an effect that the first to third antennas are held by the printed board, and the electromagnetic waves which are projected backwardly are reflected by the reflection plate so as to be concentrated to the forward direction.

The invention as recited in claim 3 of the present invention is related to such an antenna apparatus as claimed in claim 2 wherein: a plurality of antenna systems are provided and the antenna system is constituted by the first antenna to the third antenna; the plural antenna systems are constituted by printed patterns formed on a print board in such a manner that a major projection direction of the plural antenna systems is matched with a major polarized wave direction thereof; a first terminal of the power supply unit of each of the plural antenna systems is connected by a first power supply pattern formed on one surface of the printed board; and a second terminal of the power supply unit of each of the plural antenna systems is connected by a second power supply pattern formed on the other surface of the printed board. The antenna apparatus may have such an effect that the first terminals of the power supply units of the plural antenna systems are energized by the first power supply pattern formed on one surface of the printed board, whereas the second terminals of the power supply units thereof are energized by the second power supply pattern formed on the other surface of the printed board, and thus, the electromagnetic waves in which the major radiation directions thereof are matched with the major polarized wave directions thereof are radiated from the plural antenna systems.

The invention as recited in claim 4 of the present invention is related to such an antenna apparatus comprising:

a plurality of antennas formed in a diamond shape in such a manner that each of two 1-wavelength antenna elements is bent at a center thereof and the bent 1-wavelength antenna elements are located opposite to each other; a transfer path; and a reflection plate; wherein: the plurality of antennas are arranged in such a manner that the plural antennas are separated from each other by keeping an interval defined by multiplying a half wavelength by an integer along a vertical direction with respect to the plane of the diamond shape, and major polarized wave directions thereof are made identical to each other; the plurality of antennas are connected to each other by the transfer path; a tip portion of an antenna system for connecting the plurality of antennas is opened and a power supply unit is provided at the other end thereof; and the reflection plate is arranged to be separated by a predetermined interval along the vertical direction with respect to the diamond-shaped plane of the plural antennas. The antenna apparatus may have such an effect that the electromagnetic waves radiated from the plural antenna systems are emphasized with each other along the direction perpendicular to the plane of the diamond shape, and furthermore, are concentrated by the reflection plate.

The invention as recited in claim 5 of the present invention is related to such an antenna apparatus wherein: more than two sets of the antenna apparatuses recited in claim 4 are arranged along a direction parallel to a plane of a diamond shape; and the more than two antenna apparatuses are energized in a parallel manner. The antenna apparatus may own such an effect that the plural antenna apparatuses are energized in the in-phase mode, and the electromagnetic waves radiated from these antenna apparatuses are emphasized with each other.

The invention as recited in claim 6 of the present invention is related to such an antenna apparatus as claimed in by printed patterns formed on a plurality of printed boards, and the plurality of printed boards are fixed in a predetermined interval. The antenna apparatus may have such an effect that the plural antennas are held by the printed board, and a plurality of printed boards are fixed in a predetermined interval.

The invention as recited in claim 7 of the present invention is related to such an antenna apparatus as claimed in claim 6 wherein: the antenna apparatus is comprised of a relay printed board in which a transfer path is constituted by a printed pattern; and the plurality of printed boards are connected by the relay printed board. The antenna apparatus may own such an effect that a plurality of printed boards are fixed by the relay printed board in a predetermined interval, and also a plurality of antennas are connected to each other by the transfer path formed by the printed pattern on the relay print board.

The invention as recited in claim 8 of the present invention is related to such a radio apparatus comprising: a printed board in which an antenna is constructed of a printed pattern; and a wireless circuit unit; wherein: both the printed board and the wireless circuit unit are fixed in a predetermined interval; and a housing of the wireless circuit unit is commonly used as a reflection member. The radio apparatus may have such an effect that the antenna is held by the printed board, and also the interval between the printed board and the wireless circuit unit is maintained at a constant, and further, the electromagnetic waves radiated backwardly are reflected by the housing of the wireless circuit unit so as to be concentrated to the forward direction.

The invention as recited in claim 9 of the present invention is related to such a radio relaying apparatus wherein: a plurality of antenna apparatuses are arranged within the same housing in such a manner that major radiation directions of the plural antenna apparatuses are directed to different directions; and power supply units of the plural antenna apparatuses are electrically connected to each other. The radio relaying apparatus may own such an effect that the electromagnetic waves are repeated with respect to the different major radiation directions.

The invention as recited in claim 10 of the present invention is related to such a radio relaying apparatus as claimed in claim 9 wherein: each of the plural antenna apparatuses is constituted by a printed pattern formed on a printed board; and the respective power supply units of the plural antenna apparatuses are directly connected to each other by a connector for connecting the printed boards. The radio relaying apparatus may own such an effect that a plurality of antenna apparatuses are held by the printed boards respectively, and these printed boards are electrically connected to each other by the connector.

The invention as recited in claim 11 of the present invention is related to such a radio relaying apparatus wherein: a plurality of antenna apparatus are arranged within different indoor spaces from each other; and the respective power supply units of the plural antenna apparatuses are connected to each other via a cable. The radio relaying apparatus may own such an effect that since the electromagnetic waves received by the antenna apparatus arranged in a certain indoor space are transmitted from the antenna apparatus arranged in another indoor space, the electromagnetic waves can be repeated to the different indoor spaces.

The invention as recited in claim 12 of the present invention is related to such a radio relaying apparatus wherein: a plurality of antenna apparatus are embedded within walls of different rooms from each other; and the respective power supply units of the plural antenna apparatuses are connected to each other via a cable. The radio relaying apparatus may own such an effect that since the electromagnetic waves received by the antenna apparatus embedded in a certain indoor wall are transmitted from the antenna apparatus embedded in another indoor wall, the electromagnetic waves can be repeated to the different indoor spaces.

The invention as recited in claim 13 of the present invention is related to such a radio relaying apparatus as claimed in any one of the preceding claims 9 to 12 wherein: the radio relaying apparatus is comprised of: two relaying systems constructed of an upstream line and a downstream line; and the relaying system is made by connecting amplifiers among the respective power supply units of the plurality of antenna apparatuses. The radio relaying apparatus may own such an effect that the electric signals are amplified in the respective relaying systems of the upstream system and the downstream system.

The invention as recited in claim 14 of the present invention is related to such a radio relaying apparatus as claimed in any one of the preceding claims 9 to 12 wherein: a bidirectional relaying system having both a circulator and an amplifier is connected between the power supply units of the plural antenna apparatuses. The radio relaying apparatus may own such an effect that the upstream signal and the downstream signal are separated from each other in a time sequential manner by the circulator and both the upstream signal and the downstream signal are separately amplified by the amplifier.

The invention as recited in claim 15 of the present invention is related to such a radio relaying apparatus as claimed in any one of the preceding claims 9 to 12 wherein: a bidirectional relaying system having both an antenna commonly-using device and an amplifier is connected between the power supply units of the plural antenna apparatuses. The radio relaying apparatus may own such an effect that the upstream signal and the downstream signal are separated from each other in the frequency manner by the antenna commonly-using device, and both the upstream signal and the downstream signal are separately amplified by the amplifier.

BEST MODE FOR CARRYING OUT THE INVENTION

Referring now FIG. 1 to FIG. 21, embodiment modes of the present invention will be described in detail.

(FIRST EMBODIMENT MODE)

In an antenna apparatus according to a first embodiment mode, one pair of tip open diamond-shape antennas are arranged at both end portions, and four pieces of 1-wavelength loop antennas are connected in such a manner that a half-wavelength antenna portion of a center portion of each of two 1-wavelength antennas is bent at three points in a symmetrical manner with respect to a straight line intersected perpendicular to this 1-wavelength antenna element. Both ends of the 1-wavelength loop antennas are connected to one pair of the above-described diamond-shaped antennas, and further, a commonly-used power supply unit is provided.

Figure 1:
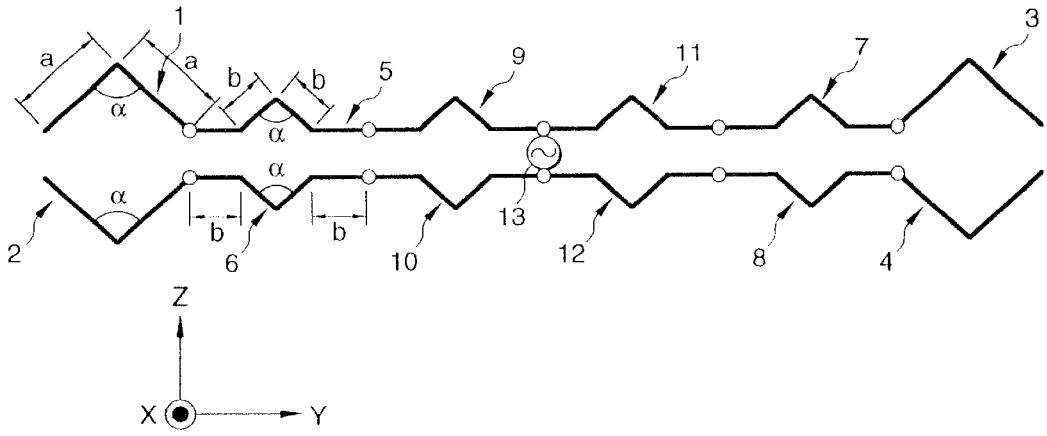
FIG. 1 shows an antenna apparatus according to a first embodiment mode.

As indicated in FIG. 1, the antenna apparatus of the first embodiment mode is provided with antenna elements 1 to 12 and a power supply unit 13.

The antenna elements 1 to 12 are arranged by a conductive line having a length of one wavelength, and are bent at center portions thereof at an angle of "$\alpha$". In general, the angle "$\alpha$" is set to be on the order of 30 to 150 degrees. In this embodiment mode, a description is made of such a case that the angle is set to 90 degrees.

As represented in FIG. 1, one pair of antenna elements 1 and 2, and one pair of antenna elements 3 and 4 are arranged opposite to each other every one pair in a diamond shape. One ends (namely, left ends as viewed in drawing) of the antenna elements 1 and 2 are connected to one pair of antenna elements 5 and 6, whereas other ends thereof are electrically opened. One ends (namely, right ends as viewed in drawing) of the antenna elements 3 and 4 are connected to one pair of antenna elements 7 and 8, whereas other ends thereof are electrically opened. Furthermore, the connection ends of the antenna elements 5 and 6 and of the antenna elements 1 and 2 are connected to one pair of antenna elements 9 and 10 located at opposite ends. Also, the connection ends of the antenna elements 7 and 8 and of the antenna elements 3 and 4 are connected to one pair of antenna elements 11 and 12 located at opposite ends. The power supply unit 13 is provided at connection points between the antenna elements 9 and 10, and the antenna elements 11 and 12. The antenna elements 5 to 12 are arranged in such a manner that these antenna elements 5 to 12 are bent at three points and located opposite to each other.

A length "a" of one side of each of the diamond shapes constituted by one pair of antennas 1 and 2, and one pair of antennas 3 and 4 is set to a ½ wavelength ($\lambda/2$). Also, a length "b" of one side of the antenna elements 5 to 12 is set to a ¼ wavelength ($\lambda/4$). For instance, in such a case that the operation frequency of the antenna apparatus is set to 1,900 MHz, a length of each of the antenna elements 1 to 4 becomes approximately 158 mm, and the length "a" of one side of the diamond shape becomes 79 mm. A length of each of the antenna elements 5 to 12 becomes approximately 158 mm, and the length "b" of one side of the diamond shape becomes 39.5 mm. Then, an entire width of the antenna apparatus becomes 762 mm.

Figure 2:
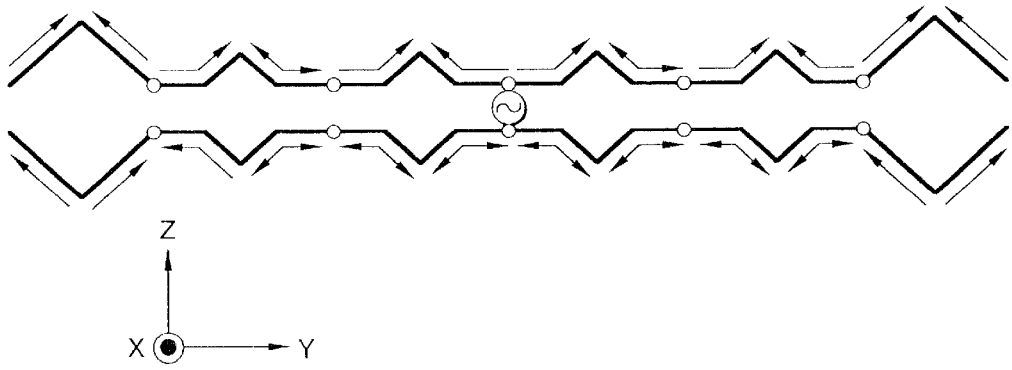
FIG. 2 represents a current distribution of the antenna apparatus according to the first embodiment mode.

In the antenna apparatus with employment of the above-explained arrangement, when the antenna apparatus is excited, or energized by such a high frequency signal having the operation frequency from the power supply unit 13, a current distribution of the antenna elements 1 to 12 is obtained as shown as an arrow of FIG. 2. In this case, both the antenna elements 1 and 2 constitute one diamond-shaped antenna, and are operated as a broad-side array antenna having 4 sets of half-wavelength antennas. This broad-side array antenna radiates electromagnetic waves along both an X direction and a −X direction, the major polarized wave direction of which is equal to a Z direction. Also, the antenna elements 3 and 4 are operated in a similar manner to these antenna elements 1 and 2. Also, the antenna elements 5 and 6 are operated as a 1-wavelength loop antenna, and radiate electromagnetic waves along both the X direction and the −X direction, the major polarized wave direction of which is equal to the Z direction. Also, the antenna elements 7 and 8 are operated in a similar manner to these antenna elements 5 and 6, and similarly, the antenna elements 9 and 10, and the antenna elements 11 and 12 are operated in a similar manner.

Figure 3:
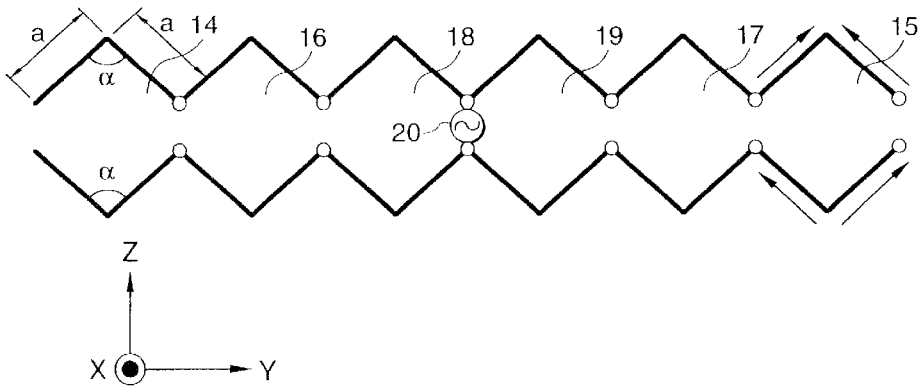
FIG. 3 PRIOR ART
FIG. 3 and FIG. 4 indicate examples of the conventional antenna apparatuses, respectively.
Figure 4:
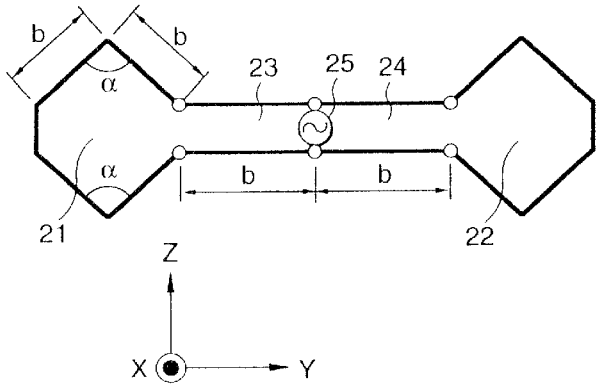
FIG. 4 PRIOR ART

With employment of the above-described arrangements, both the two diamond-shaped antennas and four 1-wavelength loop antennas can be excited in the same phase, and the electromagnetic waves can be strongly radiated along the X direction and the −X direction, the major polarized wave direction of which corresponds to the Z direction. Also, since the diamond-shaped antennas are arranged at the tip portions and also the 1-wavelength loop antennas are arranged at the center portions, the current distribution of the antenna elements at the center portions can be improved, which constitutes the problem of the conventional antenna apparatus in which a plurality of diamond-shaped antennas are arranged as shown in FIG. 3. In the antenna apparatus shown in FIG. 1, a gain of approximately 12.5 dBi can be obtained along both the X direction and the −X direction, namely can become higher than that of the antenna apparatus shown in FIG. 3 by 1 dB.

It should be noted that in this embodiment mode, the major polarized wave direction is set to the vertical (Z) direction. Alternatively, even in such a case that the antenna apparatus of FIG. 1 is rotated by 90 degrees to be arranged and the major polarized wave direction is set to the horizontal (Y) direction, this antenna apparatus may be operated in a similar manner to that of the horizontal polarized wave antenna.

As previously explained, in accordance with the antenna apparatus of the first embodiment mode, the antenna apparatus having the high gain can be realized by using the simple plane structure.

(SECOND EMBODIMENT MODE)

In an antenna apparatus according to a second embodiment mode, one pair of tip open diamond-shape antennas are arranged at both end portions, and four pieces of 1-wavelength loop antennas are connected in such a manner that a half-wavelength antenna portion of a center portion of each of two 1-wavelength antennas is bent in a semi-circular shape. Both ends of the 1-wavelength loop antennas are connected to one pair of the above-described diamond-shaped antennas, and further, a commonly-used power supply unit is provided.

Figure 5:
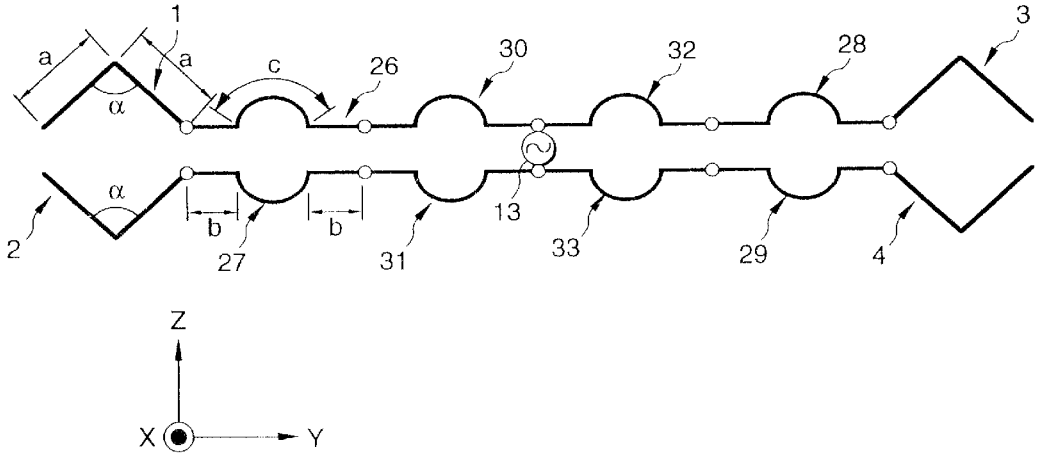
FIG. 5 to FIG. 11 show antenna apparatuses according to second through eight embodiment modes.

As indicated in FIG. 5, the antenna apparatus of the second embodiment mode is provided with antenna elements 1 and 2, antenna elements 26 to 33. It should be understood that the same reference numerals shown in FIG. 1 will be employed as those for denoting the same, or similar structures shown in FIG. 5, and these structures are operable in the same manner.

The antenna elements 26 to 33 are arranged by a conductive line having a length of 1 wavelength, and are curved at centers thereof in semi-circular shapes, whose length "c" is equal to a ½ wavelength. Also, a length "b" of a straight line portion of each of the antenna elements 26 to 33 is set to a ¼ wavelength. Then, a pair of the antenna elements 26 and 27, a pair of the antenna elements 28 and 29, a pair of the antenna elements 30 and 31, and a pair of the antenna elements 32 and 33 are arranged opposite to each other every one pair. A power supply unit 13 is provided at a connection point between the antenna elements 30 and 31, and a connection point between the antenna elements 32 and 33. Since these antenna elements are connected in this manner, both the antenna elements 26 and 27 constitute one 1-wavelength loop antenna, both the antenna elements 28 and 29 constitute one 1-wavelength loop antenna, and both the antenna elements 30 and 31 constitute one 1-wavelength loop antenna, and further, both the antenna elements 32 and 33 constitute one 1-wavelength loop antenna.

In the antenna apparatus with employment of the above-explained arrangement, when the antenna apparatus is excited, or energized by such a high frequency signal having the operation frequency from the power supply unit 13, the antenna elements 26 to 33 are operated in a similar manner to that of the antenna elements 5 to 12 shown in FIG. 1. This antenna apparatus may strongly radiate electromagnetic waves along both the X direction and the −X direction, the major polarized wave direction of which is equal to the Z direction. Similar to the antenna apparatus shown in FIG. 1, the antenna apparatus indicated in FIG. 5 can improve the current distribution of the antenna elements at the center portions, which constitutes the problem of the conventional antenna apparatus in which a plurality of diamond-shaped antennas are arranged as shown in FIG. 3. In this antenna apparatus shown in FIG. 5, a gain of approximately 12.5 dBi can be obtained along both the X direction and the −X direction, namely can become higher than that of the antenna apparatus shown in FIG. 3 by 1 dB.

As previously explained, in accordance with the antenna apparatus of the second embodiment mode, the antenna apparatus having the high gain can be realized by using the simple plane structure.

(THIRD EMBODIMENT MODE)

In an antenna apparatus according to a third embodiment mode, the antenna of the fist embodiment mode is formed on a printed board, and further, a reflection plate is fixed at a position separated from a back surface of this printed board by a predetermined distance.

Figure 6:
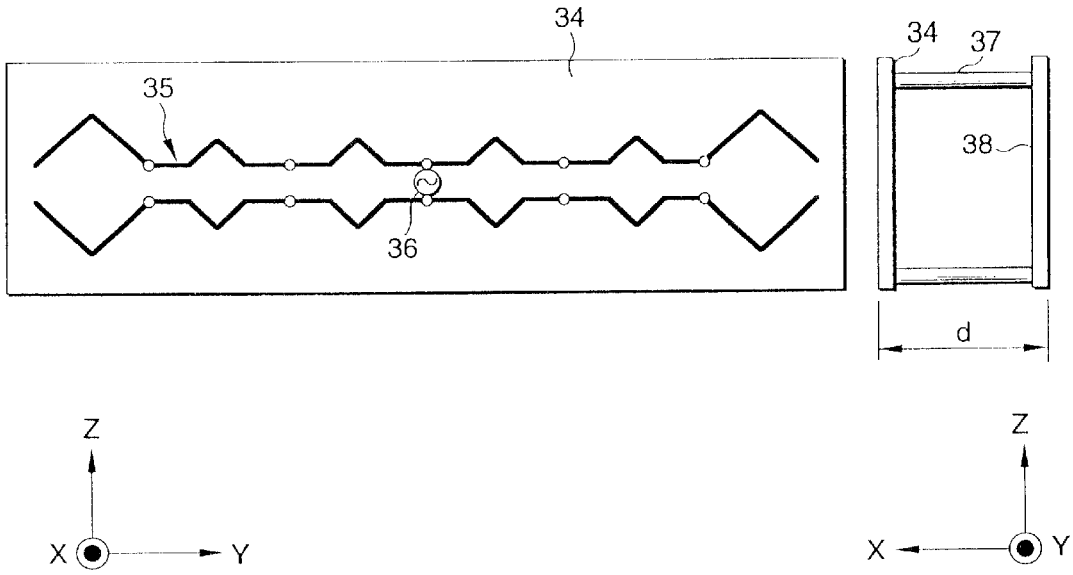

As indicated in FIG. 6, the antenna apparatus according to the third embodiment mode is provided with a dielectric board 34, an antenna pattern 35, a power supply unit 36, a supporting pillar 37, and also a reflection plate 38.

The dielectric board 34 is a printed board constructed of, for example, a glass epoxy board, and the antenna pattern 35 is constituted by a printed pattern formed on the dielectric board 34. The antenna pattern 35 is formed to have the same shape as that of the antenna elements 1 to 12 provided in the antenna apparatus shown in FIG. 1. The power supply unit 36 is arranged at a center portion of the antenna pattern 35.

The dielectric board 34 is fixed on the reflection plate 38 by the supporting pillar 37 with maintaining an interval "d." Both the dielectric board 34 and the reflection plate 38 are arranged in parallel to the Y-Z plane. The reflection plate 38 is constructed of such a metal plate having the substantially same dimension as that of the dielectric board. This reflection plate 38 is operated in such a manner that the radiation emitted from the antenna apparatus is concentrated to the X direction. The supporting pillar 37 is constituted by a non-metal material such as, for example, resin, and therefore, gives no adverse influence to the operation of the antenna apparatus. The interval "d" is set to approximately 0.3 wavelengths. In the case that the operation frequency is selected to be 1,900 MHz, an entire width of the dielectric board becomes 800 mm, and the interval "d" becomes approximately 47 mm.

In the antenna apparatus constructed of the above-explained structure, when this antenna apparatus is excited by the high frequency signal of the operation frequency derived from the power supply unit 36, the antenna pattern 35 is operated in a similar manner to that of the antenna apparatus shown in FIG. 1, according to the first embodiment mode, and thus, the radiation of this antenna pattern 35 is concentrated along the X direction by the refection plate 38. In the antenna apparatus shown in FIG. 6, a gain of approximately 16.5 dBi can be obtained along the X direction. Also, since the antenna elements are constituted by the printed pattern formed on the dielectric board, the structure for holding the antenna elements can be made simple, and the productivity can be improved.

As previously explained, in accordance with the antenna apparatus of the third embodiment mode, the antenna apparatus having the high gain can be realized by using the simple plane structure.

(FOURTH EMBODIMENT MODE)

In an antenna apparatus according to a fourth embodiment mode, a plurality of antennas according to the first embodiment modes are formed in such a manner that a major radiation direction and a major polarized wave direction are matched with each other, and further, a reflection plate is fixed at a position separated from a back surface of this printed board by a predetermined distance.

Figure 7:
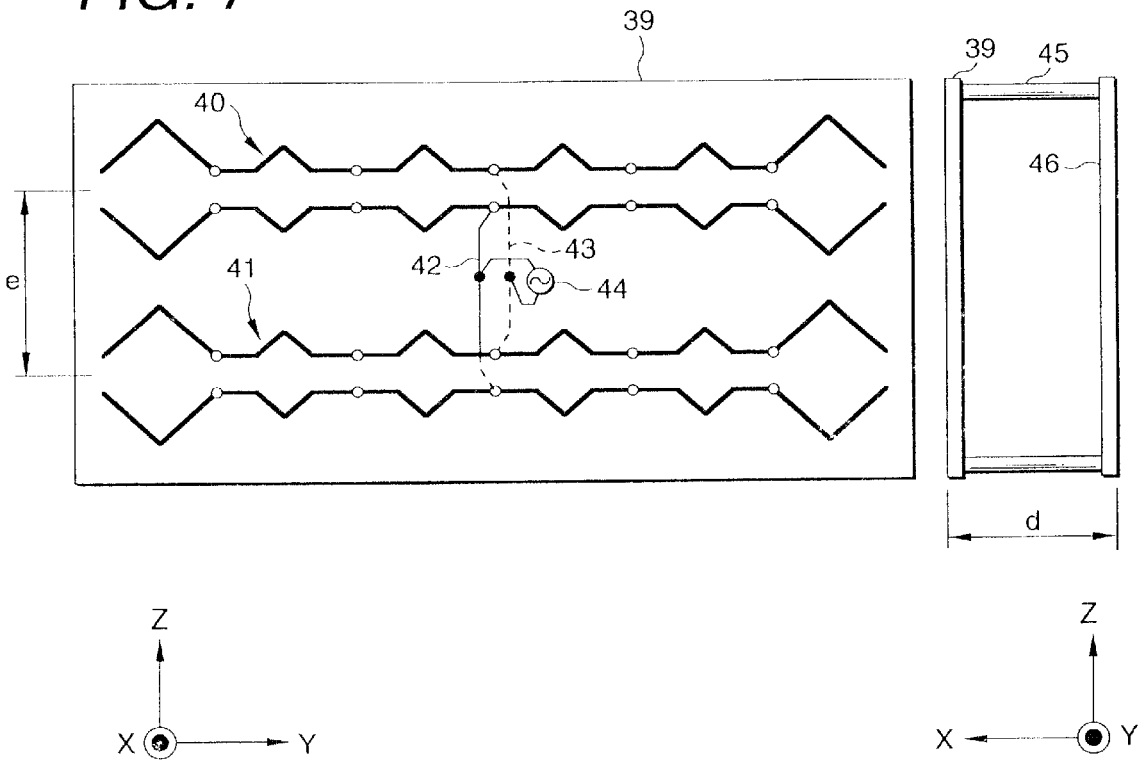

As indicated in FIG. 7, the antenna apparatus according to the fourth embodiment mode is provided with a dielectric board 39, two antenna patterns 40 and 41, a first power supply pattern 42, a second power supply pattern 43, a supporting pillar 45, a power supply unit 44, and also a reflection plate 46.

The dielectric board 39 is a printed board constructed of, for example, a glass epoxy board and is arranged in parallel to the Y-Z plane. The antenna patterns 40 and 41 are constituted by printed patterns formed on the dielectric board 39. The antenna patterns 40 and 41 are formed to have the same shapes as those of the antenna elements 1 to 12 provided in the antenna apparatus shown in FIG. 1. The antenna patterns 40 and 41 are arranged in parallel to each other in such a manner that each of major radiation directions is directed to both the X direction and the −X direction, and each of major polarized wave directions is directed to the Z direction. An interval "e" between the antenna pattern 40 and the antenna pattern 41 is set to approximately 0.8 wavelengths. The first power supply pattern 42 is formed as a printed pattern on a front surface of the dielectric board 39 in such a manner that this first power supply pattern 42 may connect one side of each of the power supply units of the antenna patterns 40 and 41. Also, the second power supply pattern 43 is formed as a printed pattern on a rear surface of the dielectric board 39 in such a manner that this second power supply pattern 43 may connect the other side of each of the power supply units of the antenna patterns 40 and 41. Also, the power supply unit 44 is connected between the first power supply pattern 42 and the second power supply patter 43. The dielectric board 39 is fixed on the reflection plate 46 by the supporting pillar 35 with maintaining an interval "d". The reflection plate 46 is constructed of such a meal plate having the substantially same dimension as that of the dielectric board. This reflection plate 46 is operated in such a manner that the radiation emitted from the antenna apparatus is concentrated to the X direction. The supporting pillar 45 is constituted by, for example, resin, and therefore, gives no adverse influence to the operation of the antenna apparatus. The interval "d" is set to approximately 0.3 wavelengths. In the case that the operation frequency is selected to be 1,900 MHz, an entire width of the dielectric board 39 becomes 800 mm, and the interval "d" becomes approximately 47 mm.

In the antenna apparatus constructed of the above-explained structure, when this antenna apparatus is excited by the high frequency signal of the operation frequency derived from the power supply unit 44, the antenna patterns 40 and 41 are operated in a similar manner to that of the antenna apparatus shown in FIG. 1, according to the first embodiment mode, and thus, the radiation of these antenna patterns 40 and 41 are concentrated along the X direction by the refection plate 46. In the antenna apparatus shown in FIG. 7, a gain of approximately 19.5 dBi can be obtained. Also, since the power supply patterns 42 and 43 are formed by employing the printed patterns formed on both the surface and the rear surface of the dielectric board 39, the structure of the antenna apparatus can be made simple and thus, the productivity can be improved. The power supply patterns 42 and 43 supply/distribute electric power to the antenna patterns 40 and 41 corresponding to two antenna systems.

As previously explained, in accordance with the antenna apparatus of the fourth embodiment mode, the antenna apparatus having the high gain can be realized by using the simple structure.

(FIFTH EMBODIMENT MODE)

In an antenna apparatus according to a fifth embodiment mode, a plurality of diamond-shaped antennas are arranged in such a manner that these plural diamond-shaped antennas are separated from each other by an interval along a vertical direction with respect to surfaces of the diamond-shapes, this interval is obtained by multiplying a half wavelength by an integer, and also major polarized wave directions are identical to each other. Also, a tip portion of an antenna system for connecting these plural diamond-shaped antennas are opened, and a power supply unit is provided at the other end of this antenna system. Furthermore, a reflection plate is arranged backwardly by a predetermined interval along the vertical direction with respect to the diamond-shaped plane of the diamond-shaped antenna where the power supply unit is provided.

Figure 8:
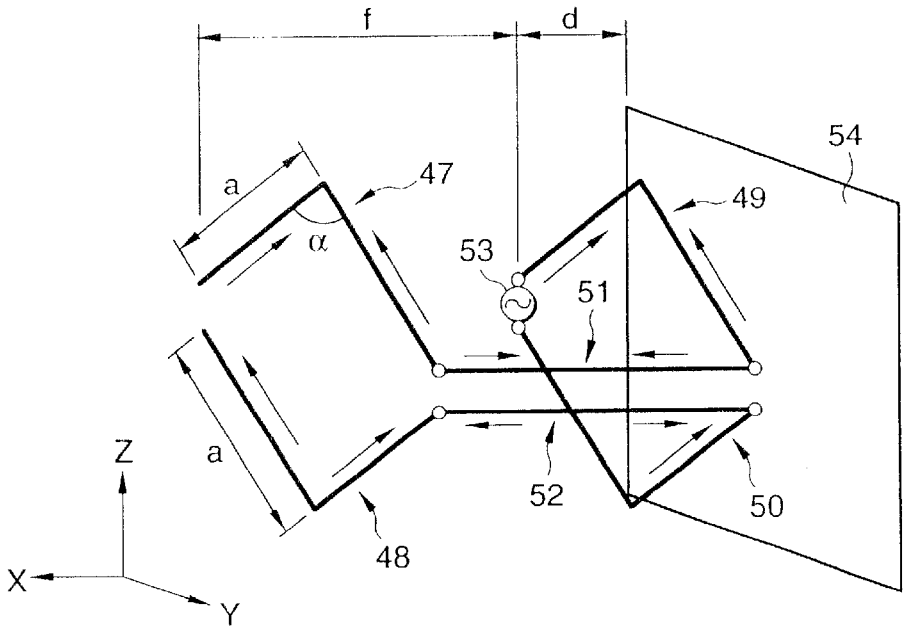

As indicated in FIG. 8, the antenna apparatus of the fifth embodiment mode is equipped with antenna elements 47 to 50, transfer paths 51 and 52, a power supply unit 53, and a reflection plate 54.

The antenna elements 47 to 50 are constituted by a conductive line having a length of 1 wavelength, and are bent at centers thereof at an angle of "α". In general, the angle "α" is set to be on the order of 30 to 150 degrees. In this embodiment mode, a description will now be made of such a case that this angle "α" is set to be 90 degrees.

As represented in FIG. 8, the antenna elements 47 and 48, and also the antenna elements 49 and 50 are arranged in the Y-Z plane opposite to a parallel diamond shape, and a length of one edge of this diamond shape is set to a ½ wavelength (λ/2). The antenna elements 47 and 48, and the antenna elements 49 and 50 constitute two diamond-shaped antennas, and are fixed in parallel to each other by an interval "f" in such a manner that major radiation directions of the respective diamond-shaped antennas are directed to both the X direction and the −X direction, whereas major polarized wave directions thereof are directed to the Z direction. The interval "f" is set to be such an interval obtained by multiplying a ½ wavelength by an integer. Both the antenna elements 47 and 48 and also the antenna elements 49 and 50 are connected to each other by the transfer paths 51 and 52 having the same length as the interval "f." In the antenna elements 49 and 50, the power supply unit 53 is connected to edges thereof located opposite to the transfer paths 51 and 52. In the antenna elements 47 and 48, edges thereof located opposite to the transfer paths 51 and 52 are opened. Also, the reflection plate 54 is arranged at a position separated from the antenna elements 49 and 50 by an interval "d." The reflection plate 54 is constituted by, for instance, a rectangular-shaped metal plane whose one end is longer than, or equal to approximately 0.9 wavelengths. The interval "d" is set to be on the order of about 0.3 wavelengths.

For instance, in the case that the operation frequency of the antenna apparatus is set to 1,900 MHz, lengths of the antenna elements 47 to 50 becomes approximately 158 mm, and also, a length of one edge of the diamond shape becomes 79 mm. Also, the interval "f" is equal to such an interval obtained by multiplying 79 mm by an integer, and the interval "d" becomes on the order to 47 mm. Also, a length of one edge of the reflection plate becomes approximately 140 mm.

In the antenna apparatus with employment of the above-explained arrangement, a description will now be made of such a case that the interval "f" is set to one wavelength (158 mm). When the antenna apparatus is excited by the high frequency signal having the operation frequency derived from the power supply unit 53, a current distribution in the antenna elements 47 to 50 and the transfer paths 51 and 52 is represented by an arrow of FIG. 8. In this case, both the antenna elements 47 and 48 constitute a diamond-shaped antenna, and this diamond-shaped antenna radiates electromagnetic waves along both the X direction and the −X direction, the major polarized wave direction of which is directed to the Z direction. Both the antenna elements 49 and 50 are operated in a similar manner to that of the antenna elements 47 and 48. Also, both the antenna elements 47 and 48 and the antenna elements 49 and 50 are excited at the same phase. As a consequence, since the two diamond-shaped antennas arranged along both the X direction and the −X direction and separated by the interval of 1 wavelength are excited in the same phase, the radiation from the respective diamond-shaped antennas may increase the strengths thereof each other along both the X direction and the −X direction. Furthermore, the radiation is concentrated to the X direction by the reflection plate 54. As a result, a high gain can be obtained along the X direction.

Also, in the case that the interval "f" is set to a ½ wavelength (79 mm), the two diamond-shaped antennas arranged along the X direction and the −X direction and separated from each other by an interval of a ½ wavelength are excited in the reverse phases. Similar to the above-explained case, also in this case, the radiation from the respective diamond-shaped antennas may increase the strengths thereof each other along both the X direction and the −X direction. Furthermore, the radiation is concentrated to the X direction by the reflection plate 54. As a result, a high gain can be obtained along the X direction. In the antenna apparatus shown in FIG. 8, a gain of approximately 13.5 dBi is obtained.

It should also be noted that in this embodiment mode, the interval "f" is equal to either the 1 wavelength of the ½ wavelength. Alternatively, even when the interval "f" is selected to be such a value obtained by multiplying the ½ wavelength by an integer, a similar operation may be carried out.

As previously explained, in accordance with the antenna apparatus of the fifth embodiment mode, the antenna apparatus having the high gain can be realized by using the simple structure.

(SIXTH EMBODIMENT MODE)

In an antenna apparatus according to a sixth embodiment mode, plural sets of the antenna apparatuses according to the fifth embodiment mode are arranged along a parallel direction with respect to a surface of a diamond shape, and are energized in a parallel manner.

Figure 9:
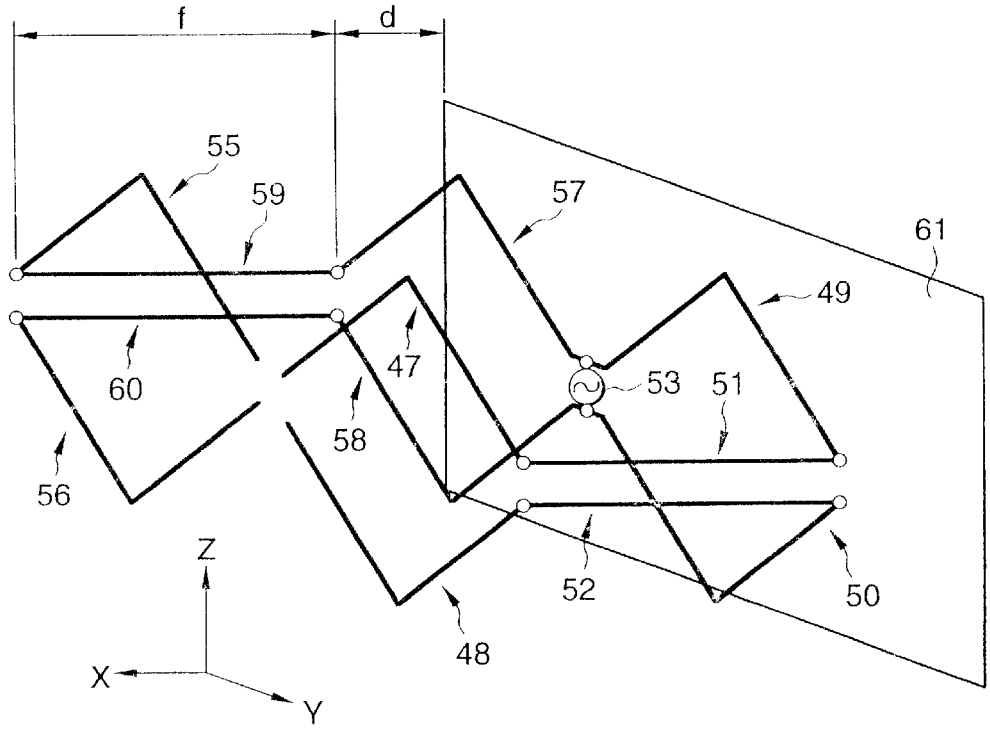

As indicated in FIG. 9, the antenna apparatus of the sixth embodiment mode is equipped with antenna elements 47 to 50, transfer paths 51 and 52, a power supply unit 53, antenna elements 55 to 58, transfer paths 59 and 60, and a reflection plate 61. It should be understood that the same reference numerals shown in FIG. 8 will be employed as those for denoting the same, or similar structures in FIG. 9, and these structures are operable in a similar manner.

The antenna elements 55 to 58 and the transfer paths 59 and 60 are arranged as the same antenna system as that of the antenna elements 47 to 50 and the transfer paths 51 and 52. These antenna elements 55 to 58, and transfer paths 59 and 60 are arranged in a symmetrical manner with respect to the X-Z plane. The power supply unit 53 is connected in parallel to both the antenna elements 49 and 50 and the antenna elements 57 and 58 so as to supply the electric power to these antenna elements 49 and 50 and also 57 and 58. The reflection plate 61 is arranged apart from the antenna elements 49 and 50 by the interval "d."

In the antenna apparatus with employment of the above-described structure, when the interval "f" is set to such an interval obtained by multiplying a ½ wavelength by an integer and also this antenna apparatus is excited by the high frequency signal of the operation frequency derived from the power supply unit 53, both the antenna elements 47 to 50 and the transfer paths 51 and 52 are operated in a similar operation to that of the antenna apparatus shown in FIG. 8, so that a high gain may be obtained along the X direction. Also, the antenna elements 55 to 58 and the transfer paths 59 and 60 are operated in a similar manner, so that a high gain can be obtained along the X direction. Furthermore, the above-explained two antenna systems are excited in the same phase, the radiation of both the antenna systems may increase strengths thereof with each other along the X direction. In the antenna apparatus shown in FIG. 9, a gain of approximately 15.5 dBi can be obtained.

As previously explained, in accordance with the antenna apparatus of the sixth embodiment mode, the antenna apparatus having the high gain can be realized by using the simple structure.

(SEVENTH EMBODIMENT MODE)

In an antenna apparatus according to a seventh embodiment mode, plural sets of the diamond-shaped antennas according to the fifth embodiment mode are formed on printed boards, and these printed boards are connected to each other by using parallel transfer path.

Figure 10:
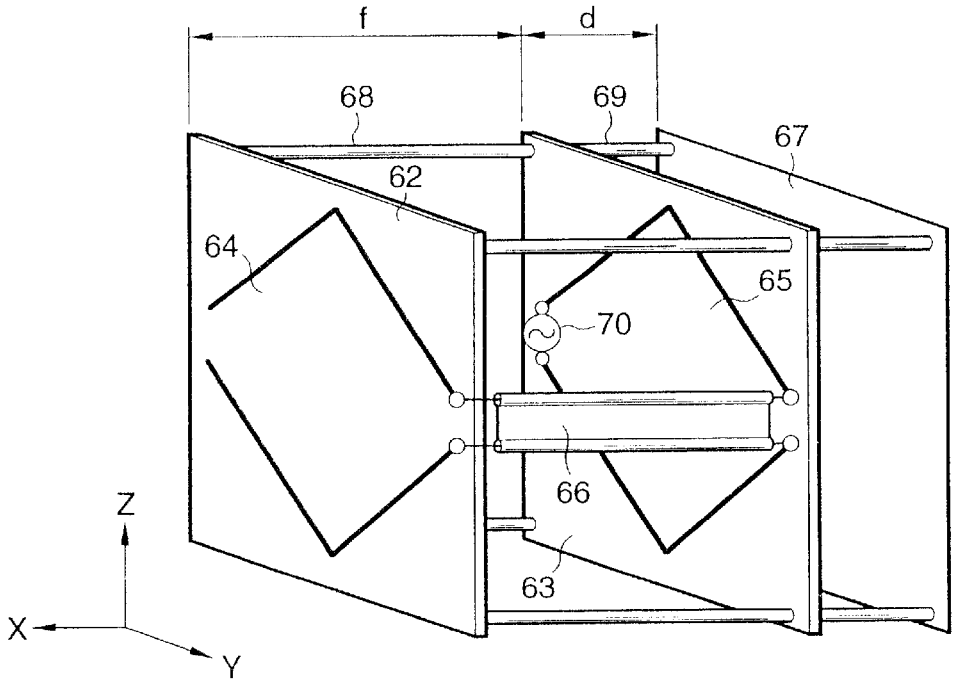

As indicated in FIG. 10, the antenna apparatus according to the seventh embodiment mode is provided with dielectric boards 62 and 63, antenna patterns 64 and 65, a transfer path 66, supporting pillars 68 and 69, and also a reflection plate 67.

The dielectric boards 62 and 63 are printed boards constructed of, for example, glass epoxy boards, and the antenna patterns 64 and 65 are constituted by printed patterns formed on the dielectric boards 62 and 64, respectively. The antenna patterns 64 and 65 are formed to have the same shapes as those of the antenna elements 47 and 48, and the antenna elements 49 and 50 provided in the antenna apparatus shown in FIG. 8.

The dielectric boards 62 and 63 are fixed in an interval "f" by the supporting pillar 68, and the dielectric board 63 is fixed on the reflection plate 67 by the supporting pillar 69 with maintaining an interval "d." Both the dielectric boards 62 and 63 and the reflection plate 67 are arranged in parallel to the Y-Z plane. The reflection plate 67 is constructed of such a metal plate having the substantially same dimension as that of the dielectric boards 62 and 63. This reflection plate 67 is operated in such a manner that the radiation emitted from the antenna apparatus is concentrated to the X direction. As the transfer path 66, for example, a parallel transfer path having a length of "f" is employed, and this parallel transfer path electrically connects the antenna pattern 64 to the antenna pattern 65. The supporting pillars 68 and 69 are constituted by non-metal materials such as, for example, resin, and therefore, gives no adverse influence to the operation of the antenna apparatus.

The interval "d" is set to approxiamately 0.3 wavelength, and also the interval "f" is set to such an interval obtained by multiplying a ½ wavelength by an integer. For instance, when the operation frequency of the antenna apparatus is set to 1,900 MHz, the interval "f" becomes such an interval obtained by multiplying 79 mm by an integer, and also the interval "d" becomes approximately 47 mm.

In the antenna apparatus constructed of the above-explained structure, when this antenna apparatus is excited by the high frequency signal of the operation frequency derived from the power supply unit 70, the antenna patterns 64 and 65, the transfer path 66, and the reflection plate 67 are operated in a similar manner to those of the antenna elements 47 to 50, the transfer paths 51 and 52, and the reflection plate 54 shown in FIG. 8, so that a high gain can be obtained along the X direction. In the antenna apparatus shown in FIG. 9, a gain of approximately 13.5 dBi can be obtained along the X direction. Also, since the antenna elements are constituted by the printed patterns formed on the dielectric boards, the structure for holding the antenna elements can be made simple, and the productivity can be improved.

As previously explained, in accordance with the antenna apparatus of the seventh embodiment mode, the antenna apparatus having the high gain can be realized by using the simple structure.

(EIGHTH EMBODIMENT MODE)

In an antenna apparatus according to an eighth embodiment mode, plural sets of the diamond-shaped antennas according to the fifth embodiment mode are formed on printed boards, and these printed boards are connected to each other by using a relay board.

Figure 11:
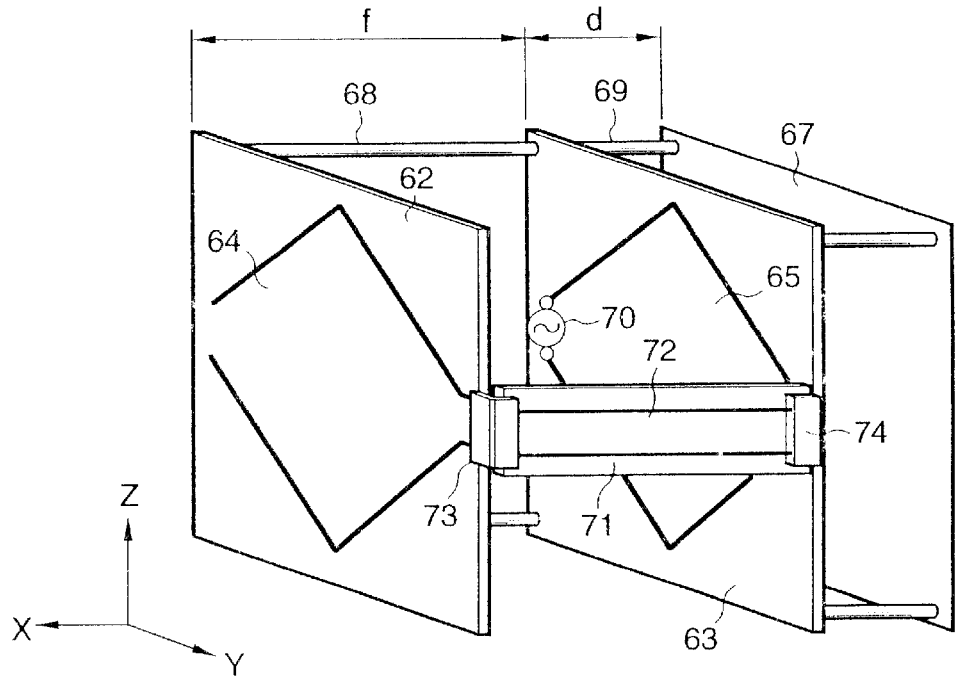

As shown in FIG. 11, the antenna apparatus of the eighth embodiment mode is provided with dielectric boards 62 and 63, antenna patterns 64 and 65, a reflection plate 67, supporting pillars 68 and 69, a relay board 71, a transfer path 72, and board connecting connectors 73 and 74. It should be understood that the same reference numerals shown in FIG. 10 will be employed as those for denoting the same, or similar structures in FIG. 11, and these structures are operable in a similar manner.

The relay board 71 is a printed board constructed of, for example, an epoxy board, and the transfer path 72 is constituted by a printed pattern which is formed on there lay board. The board connecting connectors 73 and 74 electrically connect the patterns formed on the two boards, and also mechanically connect the two boards.

A length of the relay board 71 is set to be equal to an interval "f" between the dielectric boards 62 and 63, and fixes the dielectric boards 62 and 63 in combination with the supporting pillar 68. The antenna pattern 64 is connected to a terminal of the board connecting connector 73, and the board connecting connector 73 is also connected to the transfer path 72. Similarly, the antenna pattern 65 is connected to a terminal of the board connecting connector 74, and the board connecting connector 74 is also connected to the transfer path 72. As a result, both the antenna pattern 64 and 65 are electrically connected to each other via the transfer path 72 formed on the relay board 71.

In the antenna apparatus constructed of the above-explained structure, when this antenna apparatus is excited by the high frequency signal of the operation frequency derived from the power supply unit 70, the antenna apparatus is operated in a similar manner to that of the antenna apparatus shown in FIG. 10 so as to obtain a high gain along the X direction. In the antenna apparatus shown in FIG. 11, a gain of approximately 13.5 dBi can be obtained. Also, since the transfer path for connecting the antenna patterns are constituted by the printed pattern formed on the relay board, the structure can be made simple, and the productivity can be improved.

As previously explained, in accordance with the antenna apparatus of the eighth embodiment mode, the antenna apparatus having the high gain can be realized by using the simple structure.

(NINTH EMBODIMENT MODE)

In a radio apparatus according to a ninth embodiment mode, the antenna according to the first embodiment mode is formed on the printed board, a wireless circuit unit is fixed at a position separated from a back surface of this printed board by a constant distance, and a housing of the wireless circuit unit is commonly used as a reflection plate.

Figure 12:
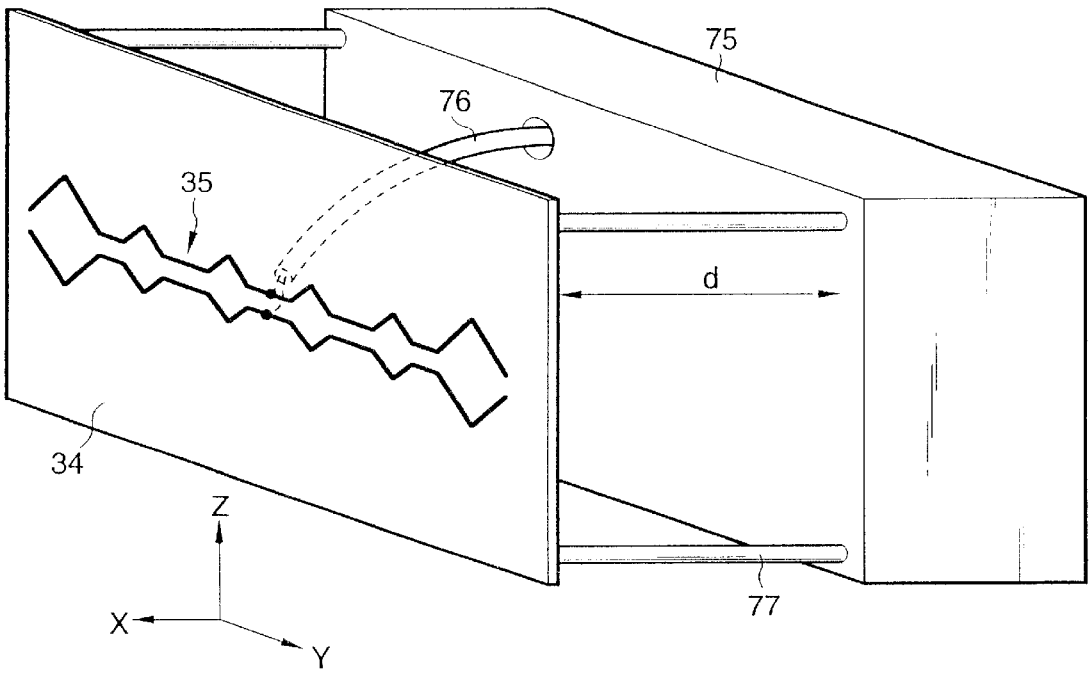
FIG. 12 represents a radio apparatus according to a ninth embodiment mode.

As indicated in FIG. 12, the radio apparatus of the ninth embodiment mode is provided with a dielectric board 34, an antenna pattern 35, a wireless circuit unit 75, a power supply cable 76, and a supporting pillar 77. It should be noted that the same reference numerals shown in FIG. 6 will be employed as those for denoting the same, or similar structures indicated in FIG. 12, and these structures are operated in a similar manner.

The wireless circuit unit 75 is a shield case for storing thereinto, for example, a transmission/reception circuit of the radio apparatus. The power supply cable 76 is a high frequency (radio frequency) cable used to connect the antenna pattern 35 to the transmission-reception circuit employed in the wireless circuit unit 75. The supporting pillar 77 fixes both the dielectric board 34 and the wireless circuit unit 35 with maintaining an interval "d". The interval "d" is set to be nearly equal to 0.3 wavelengths.

In the radio apparatus with employment of the above-described arrangement, the shield case of the wireless circuit unit 75 may play the same function as that of the reflection plate 38 shown in FIG. 6. When the radio apparatus is excited by the high frequency signal of the operation frequency via the power supply cable from the circuit employed in the wireless circuit unit 75, the antenna pattern 35 may be operated as a high gain antenna having a directivity characteristic along the X direction in combination with the wireless circuit unit 75. In this embodiment mode, a gain of approximately 16.5 dBi can be obtained along the X direction. In this case, since the reflection plate is arranged by the shield case of the wireless circuit unit 75, the structure thereof can be made simple. Also, since the radio apparatus, according to this embodiment mode, containing the antenna apparatus having the high gain is fixed as the fixed terminal on the wireless base station in such a manner that the major radiation direction of the antenna is directed toward the wireless base station, the transfer loss of the wireless system can be compensated. As a result, the wireless area covered by the wireless system can be extended.

As previously described, in accordance with the radio apparatus of the ninth embodiment mode, the radio apparatus equipped with such an antenna apparatus having a high gain can be realized with employment of a simple arrangement. Also, in the wireless system using the wireless system using the radio apparatus of the ninth embodiment mode, the wide cover area can be realized.

(TENTH EMBODIMENT MODE)

In a radio relaying apparatus according to a tenth embodiment mode, a plurality of plane antenna apparatuses are arranged within the same housing in such a manner that major radiation directions of these plane antenna apparatuses are directed to different directions from each other, and the respective power supply units of these plural antenna apparatuses are electrically connected to each other.

Figure 13:
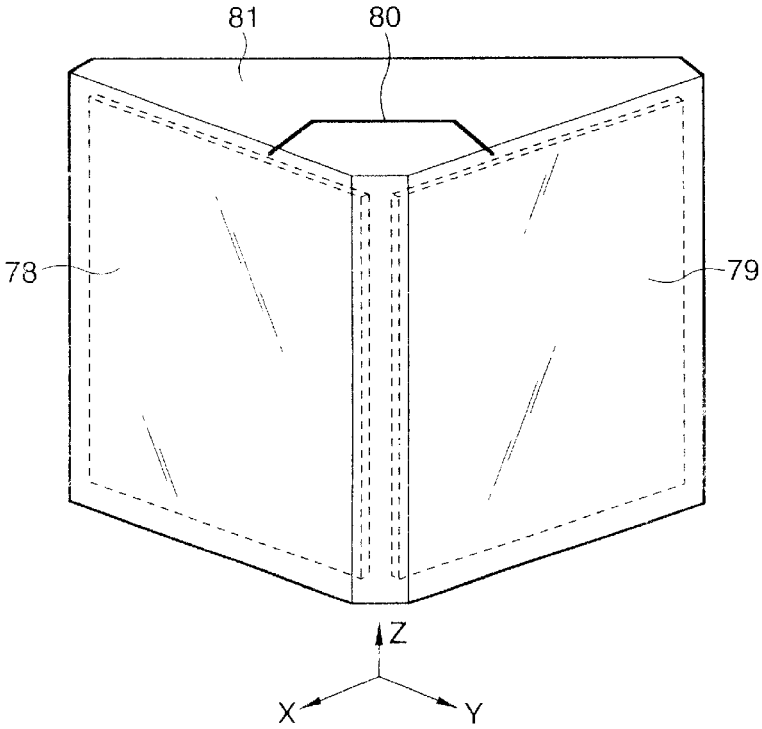
FIG. 13 shows a radio relaying apparatus according to a tenth embodiment mode.

As illustrated in FIG. 13, the radio relaying apparatus of the tenth embodiment mode is equipped with plane antennas 78 and 79, a high frequency cable 80, and a housing 81.

The plane antennas 78 and 79 are such high-gain plane antennas as patch array antennas, and are arranged within the housing 81 in such a manner that major radiation directions thereof are directed to both the X direction and the Y direction. A power supply point of the plane antenna 78 is directly connected to a power supply point of the plane antenna 79 by the high frequency cable 80. For example, assuming now that the operation frequency is 1,900 MHz, the gains of the plane antennas 78 and 79 are selected to be on the order of 15 dBi. Also, a length of the high frequency cable 80 is set within approximately several tens cm to 1 meter. The transfer loss of this high frequency cable 80 at the frequency of 1,900 MHz can be suppressed within approximately −1 dB.

In the radio relaying apparatus with employment of the above-explained arrangement, electromagnetic waves transmitted from the X direction are mainly received by the plane antenna 78 so as to excite the plane antenna 79 via the high frequency cable 80, and then the electromagnetic waves are radiated along the Y direction.

Figure 14:
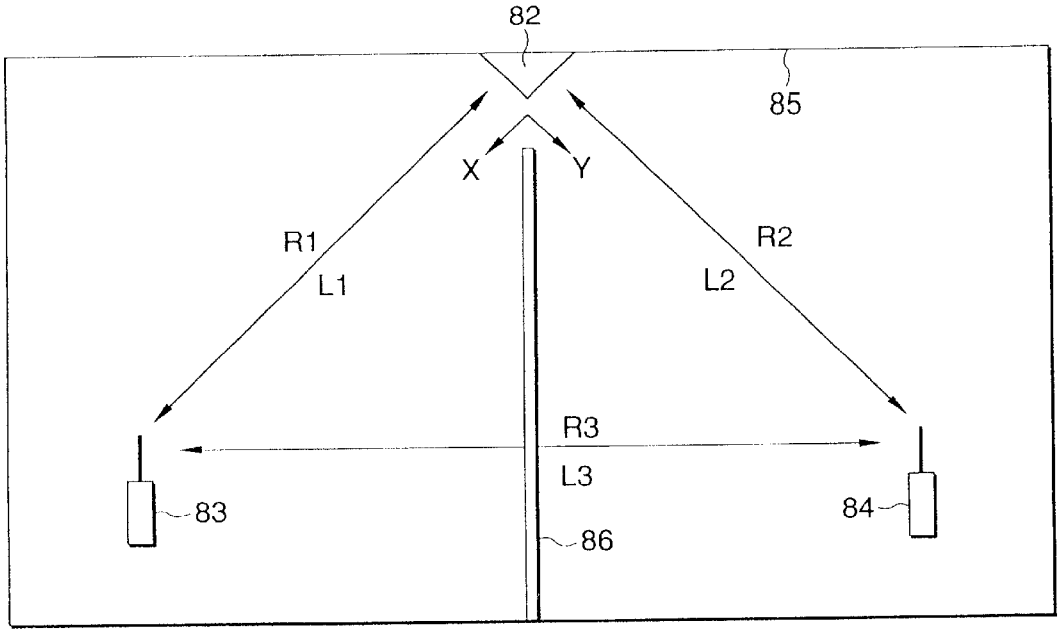
FIG. 14 represents a wireless system employing the radio relaying apparatus according to the tenth embodiment mode.

FIG. 14 represents a structural example of such a case that the radio relaying apparatus shown in FIG. 13 is utilized as, for instance, an indoor relaying apparatus of a wireless system such as the PHS system. In FIG. 14, a radio relaying apparatus 82 is installed on an indoor wall surface 85. The radio relaying apparatus 82 is operated in accordance with the same operation as that of the radio relaying apparatus shown in FIG. 13, while having the same arrangement as that of this radio relaying apparatus. The radio apparatuses 83 and 84 correspond to either terminals or base stations installed in rooms partitioned by a partition 86 having high electromagnetic shielding performance. In general, as the antennas of the radio apparatus 83 and 84, an ominidirectional antenna whose gain is lower than, or equal to approximately 2 dBi is used. In this case, assuming now that symbol "λ" is a wavelength, a transfer loss L of a free space between a distance D is expressed by as follows:

$$L=10\ \mathrm{Log}[(\lambda/4\pi D)2]\ (\mathrm{dB}) \tag{1}$$

For instance, in the case that the operation frequency is selected to be 1,900 MHz; a distance "R1" between the radio apparatus 83 and the radio relaying apparatus 82 is selected to be 15 m; another distance "R2" between the radio apparatus 84 and the radio relaying apparatus 82 is selected to be 15 m; and a straight line distance "R3" between the radio apparatus 83 and the radio apparatus 84 is selected to be 20 m, the transfer losses L1 and L2 between the respective apparatuses are given by L1=L2=−61 (dB) based upon the formula (1). A total transfer loss L12 defined from the radio apparatus 83 via the radio relaying apparatus 82 to the radio apparatus 84 is given as follow, assuming now that the gains of the plane antennas 78 and 79 of the radio relaying apparatus 82 are G1 and G2, and also the loss of the high frequency cable is Lf:

$$L12=L1+L2+G1+G2+Lf\ (\mathrm{dB}) \tag{2}$$

In this formula, assuming now that G1=G2=15 (dB) and Lf=−1 (dB), it becomes L12=−93 (dB).

Also, the transfer loss L3 occurred in the case that the partition 86 between the radio apparatus 83 and the radio apparatus 84 is not present is obtained by L3=−64 (dB) based upon the formula (1). There is such a case that the direct transfer loss "Ls" between the radio apparatus 83 and the radio apparatus 84 may exceed −100 dB, since the partition 86 is present and thus, the transmission loss of the partition 86 is produced. Assuming now that Ls=−100 dB, since L12=−93 (dB), the transfer loss between the radio apparatus 83 and the radio apparatus 84 can be improved by 7 dB by installing the radio relaying apparatus 82.

It should be noted that the shape of the radio relaying apparatus and the sort of the antenna are not limited to the above-explained shape/sort of this embodiment mode. Also, the arrangement of the wireless system is not limited to the above-described arrangement of this embodiment mode. Alternatively, a similar effect may be achieved in such a case that a high-gain antenna is directly connected to the wireless system so as to improve the transfer loss of the wireless system.

As previously explained, in accordance with the radio relaying apparatus of the tenth embodiment mode, the radio relaying apparatus installed in the indoor place can be realized with a simple arrangement. Also, the wireless system using the radio relaying apparatus of the tenth embodiment mode can realize the wide cover area.

(11TH EMBODIMENT MODE)

In a radio relaying apparatus according to an 11th embodiment mode, a plurality of antenna apparatuses of the third embodiment mode are arranged in an integral mode in such a manner that major radiation directions of these antenna apparatuses are directed to different directions from each other, and the respective power supply units of these plural antenna apparatuses are electrically connected to each other via a high frequency cable.

Figure 15:
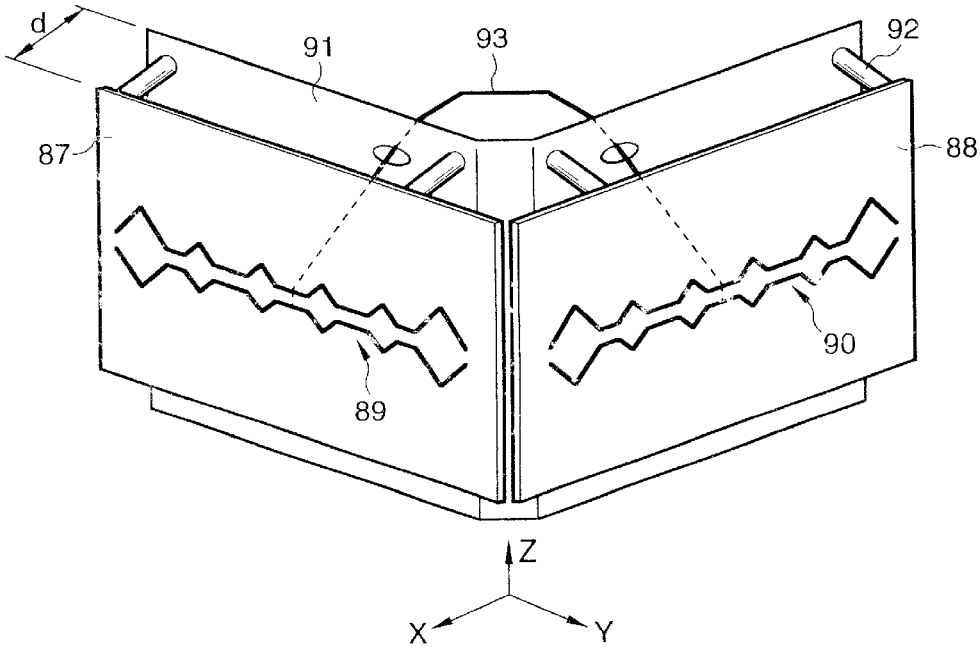
FIG. 15 to FIG. 21 illustrates radio relaying apparatuses according to 11th embodiment mode through 17th embodiment modes.

As illustrated in FIG. 15, the radio relaying apparatus of the 11th embodiment mode is equipped with dielectric boards 87 and 88, antenna patterns 89 and 90, a reflection plate 91, a supporting pillar 92, and a high frequency cable 93.

Both the dielectric board 87 and the antenna pattern 89, and both the dielectric board 88 and the antenna pattern 90 perform the same operations as that of both the dielectric board 34 and the antenna pattern 35 shown in FIG. 6, and constitute two antenna systems. The reflection plate 91 is arranged by bending one sheet of a metal plate at a center thereof, and is fixed on the dielectric boards 87 and 88 by the supporting pillar 92 in an interval "d". Both the dielectric board 87 and the antenna pattern 89 are arranged so as to be directed to the X direction, whereas both the dielectric board 88 and the antenna pattern 90 are arranged so as to be directed to the Y direction. The high frequency cable 93 is connected between the power supply unit of the antenna pattern 89 and the power supply unit of the antenna pattern 90, while this high frequency cable 93 penetrates through the reflection plate 91.

The supporting pillar 92 is constituted by a non-metal material such as, for example, resin, and therefore, gives no adverse influence to the operation of the antenna apparatus. The interval"d" isset to approximately 0.3 wavelengths. In the case that the operation frequency is selected to be 1,900 MHz, an entire width of the dielectric boards 87 and 88 becomes 800 mm, and the interval "d" becomes approximately 47 mm.

In the radio relaying apparatus with employment of the above-described arrangement, the gain inthe X direction obtained by the antenna pattern 89 is obtained as approximately 16.5 dBi, and the gain in the Y direction obtained by the antenna pattern 90 is obtained as approximately 16.5 dBi.

In the radio relaying apparatus with employment of the above-explained arrangement, electromagnetic waves transmitted from the X direction are mainly received by the antenna pattern so as to excite the antenna pattern 90 via the high frequency cable 93, and then the electromagnetic waves are radiated along the Y direction. In the case that the radio relaying apparatus shown in FIG. 15 is utilized as, for instance, an indoor relaying apparatus 82 of a wireless system such as the PHS system as shown in FIG. 14, a total transfer loss L12 defined from the radio apparatus 83 via the radio relaying apparatus 82 to the radio apparatus 84 is given as L12=−90 (dB) based upon the above-described formula (2) and G1=G2=16.5 (dBi). In the case that the direct transfer loss "Ls" occurred between the radio apparatus 83 and the radio apparatus 84 is equal to −100 (dB), the transfer loss occurred between the radio apparatus 83 and the radio apparatus 84 can be improved by 10 dB by installing the radio relaying apparatus.shown in FIG. 15. Also, since the antenna elements are constituted by the printed patterns formed on the dielectric boards, the structures for holding the antenna elements can be made simple and the productivity can be improved.

As previously explained, in accordance with the radio relaying apparatus of the 11th embodiment mode, the radio relaying apparatus installed in the indoor place can be realized with a simple arrangement. Also, the wireless system using the radio relaying apparatus of the 11th embodiment mode can realize the wide cover area.

(12TH EMBODIMENT MODE)

In a radio relaying apparatus according to a 12th embodiment mode, a plurality of antenna apparatuses of the third embodiment mode are arranged in an integral mode in such a manner that major radiation directions of these antenna apparatuses are directed to different directions from each other, and the respective power supply units of these plural antenna apparatuses are electrically and mechanically connected to each other by using a board connecting connector.

Figure 16:
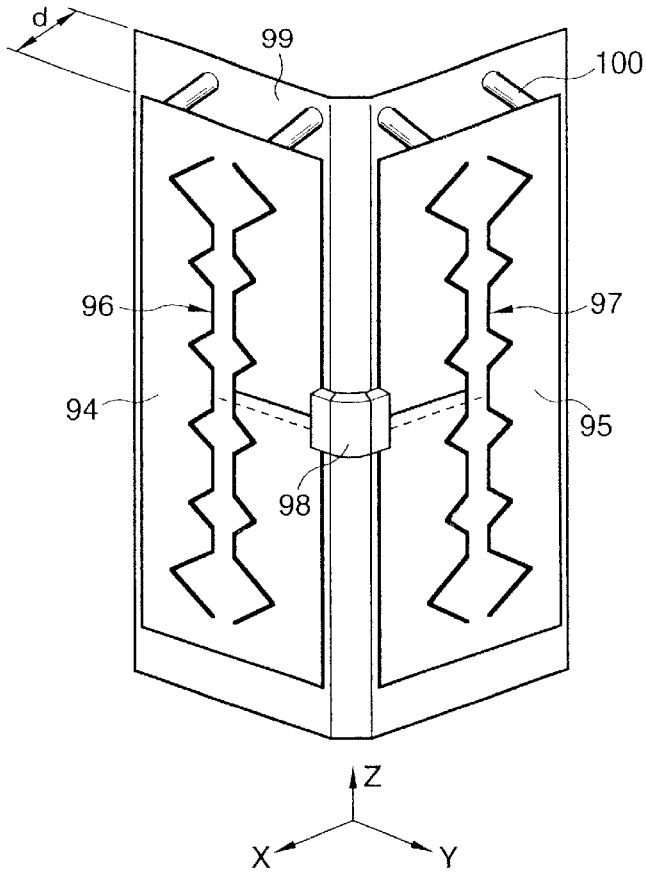

As indicated in FIG. 16, the radio relaying apparatus according to the 12th embodiment mode is equipped with dielectric boards 94 and 95, antenna patterns 96 and 97, a board connecting connector 98, a reflection plate 99, and a supporting pillar 100.

Both the dielectric board 94 and the antenna pattern 96, and both the dielectric board 95 and the antenna pattern 97 perform the same operations as that of both the dielectric board 34 and the antenna pattern 35 shown in FIG. 6, and arrange two sets of horizontal polarized wave antenna systems. The reflection plate 99 is arranged by bending one sheet of a metal plate at a center thereof, and is fixed on the dielectric boards 94 and 95 by the supporting pillar 100 in an interval "d". Both the dielectric board 94 and the antenna pattern 96 are arranged so as to be directed to the X direction, whereas both the dielectric board 95 and the antenna pattern 97 are arranged so as to be directed to the Y direction. The power supply unit of the antenna pattern 96 is connected to the power supply unit of the antenna pattern 97 via the printed patterns formed on the dielectric boards 94 and 95 and the board connecting connector 98. The board connecting connector 98 mechanically connects between the dielectric board 94 and the dielectric board 95. The supporting pillar 100 is constituted by a non-metal material such as, for example, resin, and therefore, gives no adverse influence to the operation of the antenna apparatus. The interval "d" is set to approximately 0.3 wavelengths. In the case that the operation frequency is selected to be 1,900 MHz,the interval "d" becomes approximately 47 mm.

In the radio relaying apparatus with employment of the above-described arrangement, the gain in the X direction obtained by the antenna pattern 96 is obtained as approximately 16.5 dBi, and the gain in the Y direction obtained by the antenna pattern 97 is obtained as approximately 16.5 dBi.

In the radio relaying apparatus with employment of the above-explained arrangement, electromagnetic waves transmitted from the X direction are mainly received by the antenna pattern 96 so as to excite the antenna pattern 97 via the board connecting connector 98, and then the electromagnetic waves are radiated along the Y direction. In such a case that the radio relaying apparatus shown in FIG. 16 is utilized as, for instance, an indoor relaying apparatus 82 of a wireless system such as the PHS system as shown in FIG. 14, a total transfer loss L12 defined from the radio apparatus 83 via the radio relaying apparatus 82 to the radio apparatus 84 is similarly given as L12=−90 (dB). As a result, the transfer loss can be improved by 10 dB. Also, since the connection between the antennas is realized by the board connecting connector, the high frequency cable is no longer required to be installed, so that the structure can be made simple and the productivity can be improved.

As previously explained, in accordance with the radio relaying apparatus of the 12th embodiment mode, the radio relaying apparatus installed in the indoor place can be realized with a simple arrangement. Also, the wireless system using the radio relaying apparatus of the 12th embodiment mode can realize the wide cover area.

(13TH EMBODIMENT MODE)

In a radio relaying apparatus according to a 13th embodiment mode, a plurality of antenna apparatuses are arranged at different indoor spaces, and the respective power supply units of the plural antenna apparatuses are connected to each other by a cable.

Figure 17:
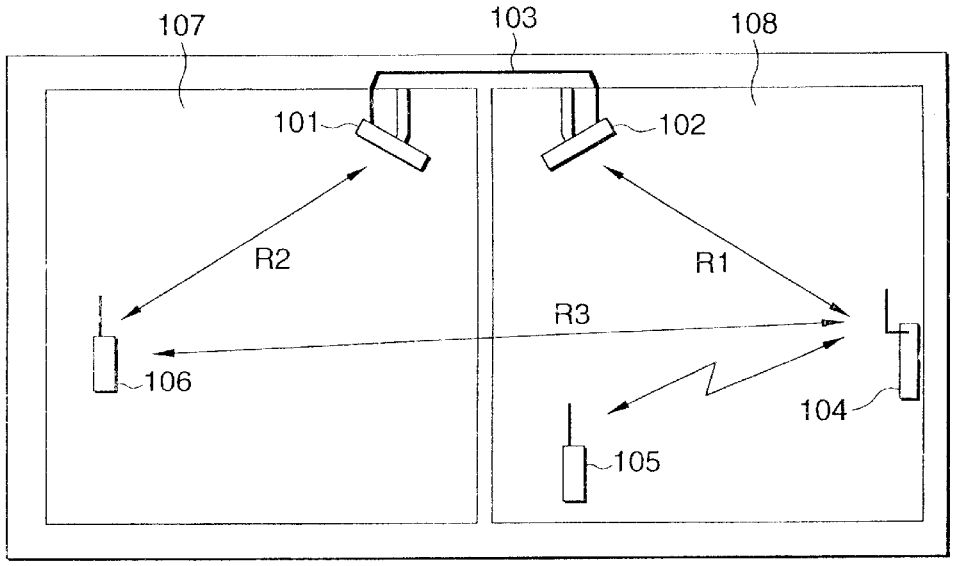

As represented in FIG. 17, the radio relaying apparatus of the 13th embodiment mode is provided with antenna apparatuses 101 and 102, and a high frequency cable 103.

The antenna apparatuses 101 and 102 correspond to such high-gain antenna apparatuses having a unidirectional directivity characteristic as shown in FIG. 6 to FIG. 11, and are installed on, for example, ceilings within an indoor space 107 and an indoor space 108. The power supply unit of the antenna apparatus 101 is connected to the power supply unit of the antenna apparatus 102 by the high frequency cable 103, while penetrating through a housing structure. As the high frequency cable 103, a low loss cable is employed. For instance, in such a case that while the operation frequency is selected to be 1,900 MHz, a length of the high frequency cable 103 is selected to be 10 m, the transfer loss "Lf" occurred in the high frequency cable 103 is nearly equal to −5 (dB).

A wireless terminal 106 is installed within the indoor space 107. Both a wireless base station 104 and a wireless terminal 105 are installed within the indoor space 108. It is now assumed that the wireless base station 104 and the wireless terminal 105 perform the wireless communication by connecting a trunk line, and also both the wireless base station 104 and the wireless terminal 106 perform the wireless communication.

In the radio relaying apparatus with employment of the above-described arrangement, electromagnetic waves transmitted from the wireless base station 104 are mainly received by the antenna apparatus 102 so as to excite the antenna apparatus 101 via the high frequency cable 103, and then, the electromagnetic waves are radiated from this antenna apparatus 101 to the wireless terminal 106. Similarly, the electromagnetic waves transmitted from the wireless terminal 106 are received by the wireless base station 104 via the antenna apparatus 101, the high frequency cable 103, and the antenna apparatus 102.

In this case, it is so assumed that the antenna apparatuses 101 and 102 are fixed in such a manner that the major radiation directions of these antenna apparatuses are directed to the wireless terminal 106 and the wireless base station 104. In the case that a distance "R1" between the wireless base station 104 and the antenna apparatus 102 is selected to be 10 m, and another distance "R2" between the wireless terminal 106 and the antenna apparatus 101 is selected to be 10 m, a total transfer loss "L12" defined from the wireless base station 104 via the antenna apparatus 102, the high frequency cable 103, and the antenna apparatus 101 up to the wireless terminal 106 is equal to −88 (dB) based upon the formulae (1) and (2). There are some cases that the direct transfer loss "Ls" defined from the wireless base station 104 to the wireless terminal 106 when this relaying system is not present may exceed −100 dB, due to the transmission loss caused by the electromagnetic shield between the indoor spaces 107 and 108. Assuming now that Ls=−100 (dB), the transfer loss defined from the wireless base station 104 to the wireless terminal 106 can be improved by 12 dB, since the radio relaying apparatus is installed, and is constituted by the antenna apparatus 101, the high frequency cable 103, and the antenna apparatus 102.

It should be noted that the shapes of the indoor spaces and the mounting positions of the antenna apparatuses are not limited to the above-explained description of this embodiment mode. Alternatively, a similar effect may be achieved when high-gain antennas arranged in different indoor spaces are directly connected to each other by way of a cable in order to improve the transfer loss of the wireless system.

As previously explained, in accordance with the radio relaying apparatus of the 13th embodiment mode, the radio relaying apparatus installed in the indoor place can be realized with a simple arrangement. Also, the wireless system using the radio relaying apparatus of the 13th embodiment mode can realize the wide cover area.

(14TH EMBODIMENT MODE)

In a radio relaying apparatus according to a 14th embodiment mode, a plurality of antenna apparatuses are embedded in different indoor walls, and the respective power supply units of the plural antenna apparatuses are connected to each other by a cable.

Figure 18:
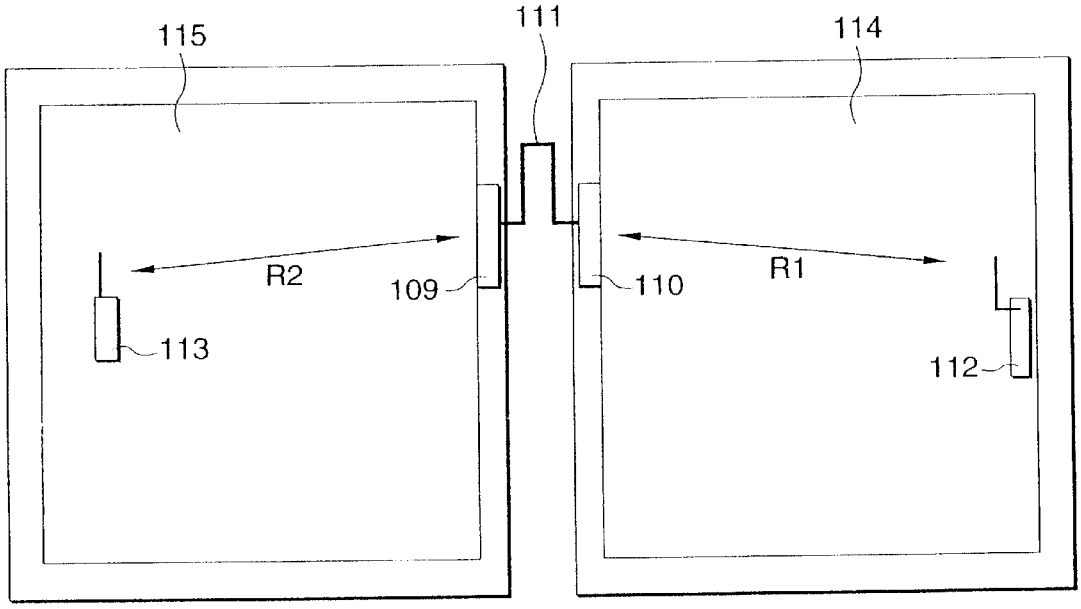

As represented in FIG. 18, the radio relaying apparatus of the 14th embodiment mode is provided with antenna apparatuses 109 and 110, and a high frequency cable 111.

The antenna apparatuses 109 and 110 correspond to such high-gain antenna apparatuses having a unidirectional directivity characteristic as shown in FIG. 6 to FIG. 11, and are embedded in, for example, walls within an indoor space 114 and an indoor space 115. The power supply unit of the antenna apparatus 109 is connected to the power supply unit of the antenna apparatus 110 by the high frequency cable 111, while penetrating through a housing structure. As the high frequency cable 111, a low loss cable is employed. For instance, in such a case that while the operation frequency is selected to be 1,900 MHz, a length of the high frequency cable 111 is selected to be 10 m, the transfer loss "Lf" occurred in the high frequency cable 111 is nearly equal to −5 (dB). A wireless base station 112 is installed within an indoor space 114. A wireless terminal 113 is installed within the indoor space 115. It is now assumed that the wireless base station 112 and the wireless terminal 113 perform the wireless communication by connecting a trunk line.

In the radio relaying apparatus with employment of the above-described arrangement, electromagnetic waves transmitted from the wireless base station 112 are mainly received by the antenna apparatus 110 so as to excite the antenna apparatus 109 via the high frequency cable 111, and then, the electromagnetic waves are radiated from this antenna apparatus 109 to the wireless terminal 113. Similarly, the electromagnetic waves transmitted from the wireless terminal 113 are received by the wireless base station 114via the antenna apparatus 109, the high frequency cable 111, and the antenna apparatus 160. As previously explained, in the radio relaying apparatus shown in FIG. 18, the transfer loss occurred between the wireless base station 112 and the wireless terminal 113 can be improved in a similar manner to that of the radio relaying apparatus shown in FIG. 17. In this case, since both the antenna apparatus 109 and the antenna apparatus 110 are embedded in the walls of the indoor spaces, there is a small number of projected portions within the indoor spaces. As a consequence, there is no interference between these antenna apparatuses and subjects provided in the indoor spaces, so that occurrences of malfunction are decreased and also better indoor observations can be maintained.

As previously explained, in accordance with the radio relaying apparatus of the 14th embodiment mode, the radio relaying apparatus installed in the indoor place can be realized with a simple arrangement. Also, the wireless system using the radio relaying apparatus of the 14th embodiment mode can realize the wide cover area.

(15TH EMBODIMENT MODE)

In a radio relaying apparatus according to a 15th embodiment mode, two relaying systems constituted by an upstream line system and a downstream line system, to which amplifiers are connected, are provided between the respective power supply units of a plurality of antenna apparatuses.

Figure 19:
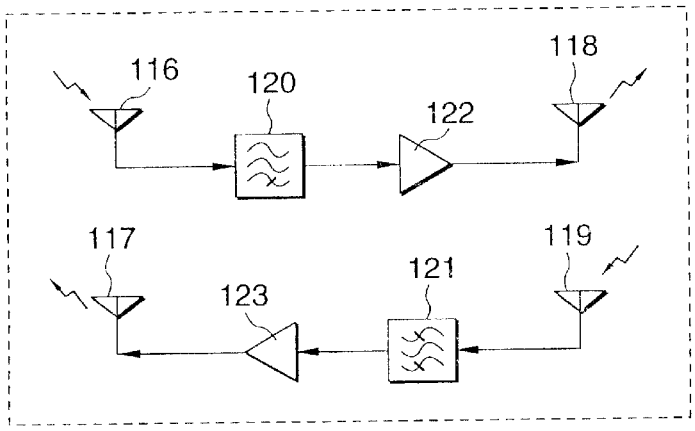

As shown in FIG. 19, the radio relaying apparatus of the 15th embodiment mode is equipped with antenna apparatuses 116 to 119, bandpass filters 120 and 121, and low noise amplifiers 122 and 123.

The antenna apparatuses 116 to 119 correspond to such high-gain antenna apparatuses having a unidirectional directivity characteristic as represented in FIG. 6 to FIG. 11. Similar to the radio relaying apparatus as shown in FIG. 13 to FIG. 18, there antenna apparatuses 116 to 119 are arranged so as to improve a transfer loss of a wireless system. A signal received by the antenna apparatus 116 is entered via the bandpass filter 120 into the low noise amplifier 122 so as to be amplified, and thereafter, the amplified signal is radiated from the antenna apparatus 118. Similarly, a signal received by the antenna apparatus 119 is inputted via the bandpass filter 121 into the low noise amplifier 123 so as to be amplified, and thereafter, the amplified signal is radiated from the antenna apparatus 117.

The radio relaying apparatus with employment of the above-described arrangement is used in a frequency division duplexing (FDD) type wireless system. Since the upstream frequency range is different from the downstream frequency range in the frequency division duplexing (FDD) system, the radio relaying apparatus of this embodiment mode is provided with the relaying system for the upstream frequency range and also the relaying system for the downstream frequency range. The antenna apparatuses 116 and 118 are such antenna apparatuses corresponding to, for example, the upstream frequency range, and both the bandpass filter 120 and the low noise amplifier 122 correspond to the upstream frequency range. Also, the antenna apparatuses 117 and 119, the bandpass filter 121, and the low noise amplifier 123 correspond to the downstream frequency range.

Assuming now that, for example, gains of the low noise amplifiers 122 and 123 are selected to be 20 dB and the noise figures thereof are neglected, in accordance with the radio relaying apparatus shown in FIG. 19, the improvement effect of the transfer loss can be increased by 20 dB with respect to such a radio relaying apparatus that the antenna apparatuses are directly connected to each other as represented in FIG. 13 to FIG. 18.

As previously described, in the antenna apparatus of the 15th embodiment mode, the radio relaying apparatus having the high relaying performance, which is installed in the indoor place, can be realized with the simple structure in the frequency division duplexing (FDD) system. Also, in the wireless system using the radio relaying apparatus of the 15th embodiment mode, this wireless system can realize the wide cover area.

(16TH EMBODIMENT MODE)

In a radio relaying apparatus according to a 16th embodiment mode, a bidirectional relaying system having circulators and amplifiers are connected between the respective power supply units of a plurality of antenna apparatuses.

Figure 20:
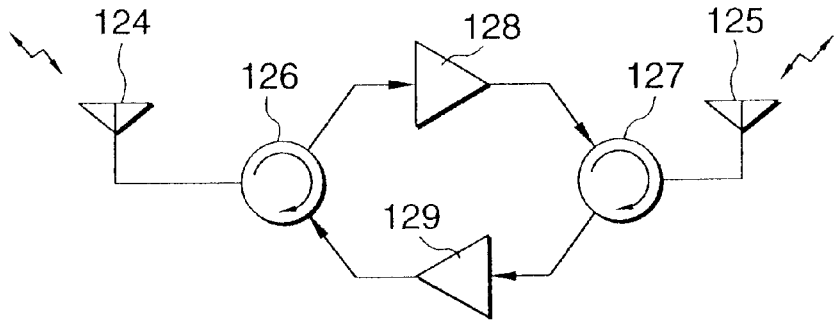

As shown in FIG. 20, the radio relaying apparatus of the 16th embodiment mode is equipped with antenna apparatuses 124 and 125, circulators 126 and 127, and low noise amplifiers 128 and 129.

The antenna apparatuses 124 to 125 correspond to such high-gain antenna apparatuses having a unidirectional directivity characteristic as represented in FIG. 6 to FIG. 11. Similar to the radio relaying apparatus as shown in FIG. 13 to FIG. 18, there antenna apparatuses 124 and 125 are arranged so as to improve a transfer loss of a wireless system. A signal received by the antenna apparatus 124 is entered via the circulator 126 into the low noise amplifier 128 so as to be amplified, and thereafter, the amplified signal is radiated from the antenna apparatus 125 via the circulator 127. Similarly, a signal received by the antenna apparatus 125 is inputted via the circulator 127 into the low noise amplifier 129 so as to be amplified, and thereafter, the amplified signal is radiated from the antenna apparatus 124 via the circulator 126.

The radio relaying apparatus with employment of the above-described arrangement is used in a time division duplexing (TDD) type wireless system. In the time division duplexing (TDD) system, the same frequency range is commonly used in the upstream line and the downstream line, and the upstream line is separated from the downstream line by the time-divided sections. As a consequency, the radio relaying apparatus according to this embodiment mode owns two relaying systems having the same frequency range, and the bidirectional characteristic is realized by the circulators.

For example, assuming now that transmission losses of the circulators 126 and 127 are selected to be 1 dB, gains of the low noise amplifiers 122 and 123 are selected to be 20 dB and the noise figures thereof are neglected, in accordance with the radio relaying apparatus shown in FIG. 20, the improvement effect of the transfer loss can be increased by 18 dB with respect to such a radio relaying apparatus that the antenna apparatuses are directly connected to each other as represented in FIG. 13 to FIG. 18.

It should be noted that in this embodiment mode, the bidirectional characteristic is realized by the circulators. Alternatively, for example, a similar effect may be achieved by employing such a high frequency switch which is switched in synchronism with the transmission/reception switching time instant in the TDD system.

As previously described, in the antenna apparatus of the 16th embodiment mode, the radio relaying apparatus having the high relaying performance, which is installed in the indoor place, can be realized with the simple structure in the time division duplexing (TDD) system. Also, in the wireless system using the radio relaying apparatus of the 16th embodiment mode, this wireless system can realize the wide cover area.

(17TH EMBODIMENT MODE)

In a radio relaying apparatus according to a 17th embodiment mode, a bidirectional relaying system having an antenna commonly-using device and an amplifier are connected between the respective power supply units of a plurality of antenna apparatuses.

Figure 21:
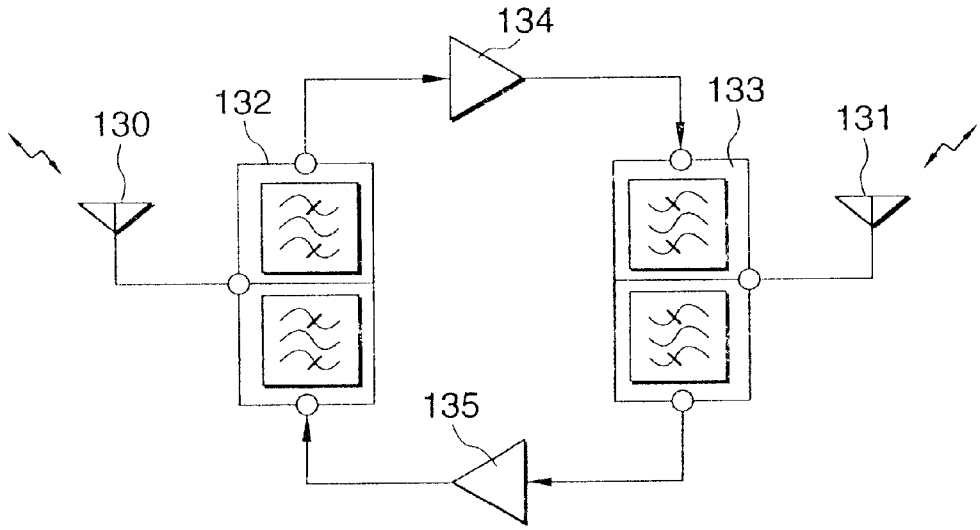

As shown in FIG. 21, the radio relaying apparatus of the 17th embodiment mode is equipped with antenna apparatuses 130 and 131, antenna commonly-using devices 132 and 133, and low noise amplifiers 134 and 135.

The antenna apparatuses 130 and 131 correspond to such high-gain antenna apparatuses having a unidirectional directivity characteristic as represented in FIG. 6 to FIG. 11. Similar to the radio relaying apparatus as shown in FIG. 13 to FIG. 18, there antenna apparatuses 130 and 131 are arranged so as to improve a transfer loss of a wireless system. A signal received by the antenna apparatus 130 is entered via the antenna commonly-using device 132 into the low noise amplifier 134 so as to be amplified, and thereafter, the amplified signal is radiated from the antenna apparatus 131 via the antenna commonly-using device 133. Similarly, a signal received by the antenna apparatus 131 is inputted via the antenna commonly-using device 133 into the low noise amplifier 135 so as to be amplified, and thereafter, the amplified signal is radiated from the antenna apparatus 130 via the antenna commonly-using device 132.

The radio relaying apparatus with employment of the above-described arrangement is used in a frequency division duplexing (FDD) type wireless system. There are provided the upstream frequency range and the downstream frequency range in the wireless relaying system shown in FIG. 19. In the radio relaying apparatus of this embodiment mode shown in FIG. 21, the antenna apparatus is commonly used in both the upstream frequency range and the downstream frequency range by employing both the antenna commonly-using devices 132 and 133. Both the antenna apparatus 130 and the antenna apparatus 131 correspond to both the upstream frequency range and the downstream frequency range. Also, the low noise amplifier 134 corresponds to, for instance, the upstream frequency range, and the low noise amplifier 135 corresponds to the downstream frequency range. The antenna commonly-using device 132 is operated in such a manner that the input/output of the antenna apparatus 130 are connected to the low noise amplifier 134 in the upstream frequency range, and are connected to the low noise amplifier 135 in the downstream frequency range. Also, the antenna commonly-using device 133 is operated in such a manner that the input/output of the antenna apparatus 131 are connected to the low noise amplifier 134 in the upstream frequency range, and are connected to the low noise amplifier 135 in the downstream frequency range. Assuming now that, for example, transmission loss of the antenna commonly-using devices is selected to be 1 dB, gains of the low noise amplifiers 134 and 135 are selected to be 20 dB and the noise figures thereof are neglected, in accordance with the radio relaying apparatus shown in FIG. 21, the improvement effect of the transfer loss can be increased by 18 dB with respect to such a radio relaying apparatus that the antenna apparatuses are directly connected to each other as represented in FIG. 13 to FIG. 18. As previously explained, since both the broad-band antenna apparatuses 130 and 131, and further, both the antenna commonly-using devices 132 and 133 are prepared, a total number of antennas can be reduced to be 2.

As previously described, in the antenna apparatus of the 15th embodiment mode, the wireless relaying apparatus having the high relaying performance, which is installed in the indoor place, can be realized with the simple structure in the frequency division duplexing (FDD) system. In such a simple structure, a total number of antenna apparatus is suppressed to be 2. Also, in the wireless system using the radio relaying apparatus of the 17th embodiment mode, this wireless system can realize the wide cover area.

Utilizability in Industrial Field

As previously described in detail, in accordance with the antenna apparatus of the present invention, this antenna apparatus is arranged by that a first antenna and a second antenna are arranged on both end portions in such a manner that each of two 1-wavelength antenna elements is bent at a center portion thereof and the two bent 1-wavelength antenna elements are located opposite to each other so as to thereby form a diamond shape; one end of the first and second antennas is opened; and a connection unit is provided on the other end thereof; a third antenna in which a central half-wavelength portion of each of two 1-wavelength antenna elements is bent in a symmetrical manner with respect to a straight line intersected perpendicular to the antenna elements is arranged at a center portion, both ends of which are connected to the first and second antennas; and a commonly-used power supply unit is provided. As a result, the antenna apparatus having the high gain can be realized with the simple plane structure.

Also, an antenna apparatus, according to the present invention, is arranged by comprising: a plurality of antennas formed in a diamond shape in such a manner that each of two 1-wavelength antenna elements is bent at a center thereof and the bent 1-wavelength antenna elements are located opposite to each other; a transfer path; and a reflection plate; wherein:

the plurality of antennas are arranged in such a manner that the plural antennas are separated from each other by keeping an interval defined by multiplying a half wavelength by an integer along a vertical direction with respect to the plane of the diamond shape, and major polarized wave directions thereof are made identical to each other; the plurality of antennas are connected to each other by the transfer path; a tip portion of an antenna system for connecting the plurality of antennas is opened and a power supply unit is provided at the other end thereof; and the reflection plate is arranged to be separated by a predetermined interval along the vertical direction with respect to the diamond-shaped plane of the plural antennas. As a result, the antenna apparatus having the high gain can be realized with the simple structure.

A radio apparatus, according to the present invention, is arranged by comprising: a printed board in which an antenna is constructed of a printed pattern; and a wireless circuit unit; wherein: both the printed board and the wireless circuit unit are fixed in a predetermined interval; and a housing of the wireless circuit unit is commonly used as a reflection member. As a consequence, the radio apparatus equipped with the antenna apparatus having the high gain can be realized with the simple arrangement.

A radio relaying apparatus, according to the present invention, is arranged by that a plurality of antenna apparatuses are arranged within the same housing in such a manner that major radiation directions of the plural antenna apparatuses are directed to different directions; and power supply units of the plural antenna apparatuses are electrically connected to each other. As a consequence, the radio relaying apparatus installed in the indoor place can be realized with the simple arrangement.

A radio relaying apparatus, according to the present invention, is arranged by that a plurality of antenna apparatus are arranged within different indoor spaces from each other; and the respective power supply units of the plural antenna apparatuses are connected to each other via a cable. As a consequence, the radio relaying apparatus installed in the indoor place can be realized with the simple arrangement.

Further, a radio relaying apparatus, according to the present invention, is arranged by that a plurality of antenna apparatus are embedded within walls of different rooms from each other; and the respective power supply units of the plural antenna apparatuses are connected to each other via a cable. As a consequence, the radio relaying apparatus installed in the indoor place can be realized with the simple arrangement.

What is claimed is:

1. An antenna apparatus wherein:

a first antenna and a second antenna are arranged on both end portions in such a manner that each of two 1-wavelength antenna elements is bent at a center portion thereof and the two bent 1-wavelength antenna elements are located opposite to each other so as to thereby form a diamond shape; one end of said first and second antennas is opened; and a connection unit is provided on the other end thereof;

a third antenna in which a central half-wavelength portion of each of two 1-wavelength antenna elements is bent in a symmetrical manner with respect to a straight line intersected perpendicular to said antenna elements is arranged at a center portion, both ends of which are connected to said first and second antennas; and a commonly-used power supply unit is provided.

2. An antenna apparatus as claimed in claim 1 wherein:

said first to third antennas are constituted by printed patterns formed on a printed board, and both said printed board and a reflection plate are fixed in a predetermined interval.

3. An antenna apparatus as claimed in claim 2 wherein:

a plurality of antenna systems are provided and said antenna system is constituted by said first antenna to said third antenna;

said plural antenna systems are constituted by printed patterns formed on a print board in such a manner that a major projection direction of said plural antenna systems is matched with a major polarized wave direction thereof;

a first terminal of the power supply unit of each of said plural antenna systems is connected by a first power supply pattern formed on one surface of the printed board; and a second terminal of the power supply unit of each of said plural antenna systems is connected by a second power supply pattern formed on the other surface of the printed board.

4. An antenna apparatus comprising:

a plurality of antennas formed in a diamond shape in such a manner that each of two 1-wavelength antenna elements is bent at a center thereof and the bent 1-wavelength antenna elements are located opposite to each other;

a transfer path; and a reflection plate; wherein:

said plurality of antennas are arranged in such a manner that said plural antennas are separated from each other by keeping an interval defined by multiplying a half wavelength by an integer along a vertical direction with respect to a plane of said diamond shape, and major polarized wave directions thereof are made identical to each other;

said plurality of antennas are connected to each other by the transfer path;

a tip portion of an antenna system for connecting said plurality of antennas is opened and a power supply unit is provided at the other end thereof; and said reflection plate is arranged to be separated by a predetermined interval along the vertical direction with respect to the diamond-shaped plane of said plural antennas.

5. An antenna apparatus wherein:

more than two sets of the antenna apparatuses recited in claim 4 are arranged along a direction parallel to a plane of a diamond shape; and said more than two antenna apparatuses are energized in a parallel manner.

6. An antenna apparatus as claimed in claim claim 4, or claim 5 wherein:

said plural antennas are constituted by printed patterns formed on a plurality of printed boards, and said plurality of printed boards are fixed in a predetermined interval.

7. An antenna apparatus as claimed in claim 6 wherein:

said antenna apparatus is comprised of a relay printed board in which the transfer path is constituted by a printed pattern; and said plurality of printed boards are connected by said relay printed board.

* * * * *